US010239198B2

(12) United States Patent
Kinskey

(10) Patent No.: US 10,239,198 B2
(45) Date of Patent: Mar. 26, 2019

(54) MULTIFUNCTION TOOL BAR

(71) Applicant: L.F. Centennial Ltd., Road Town, Tortola (VG)

(72) Inventor: Terrence P. Kinskey, Marietta, GA (US)

(73) Assignee: L.F. CENTENNIAL LTD., Road Town, Tortola (VG)

( * ) Notice: Subject to any disclaimer, the term of this patent is extended or adjusted under 35 U.S.C. 154(b) by 0 days.

(21) Appl. No.: 15/459,351

(22) Filed: Mar. 15, 2017

(65) Prior Publication Data

US 2017/0266804 A1 Sep. 21, 2017

Related U.S. Application Data

(60) Provisional application No. 62/308,571, filed on Mar. 15, 2016.

(51) Int. Cl.
*B25H 3/04* (2006.01)
*B65D 33/14* (2006.01)

(52) U.S. Cl.
CPC ..... *B25H 3/04* (2013.01); *B65D 33/14* (2013.01)

(58) Field of Classification Search
CPC ..... B25H 3/04; B65D 33/14; A47F 7/0028; A47F 2005/026; A47F 5/021; F41C 33/006
USPC ..... 211/70.6, 87.01, 113, 94.01; 224/269, 224/271, 197, 666, 663, 195, 682, 904; 383/22–24; D3/224
See application file for complete search history.

(56) References Cited

U.S. PATENT DOCUMENTS 1,575,270 A * 3/1926 Jankowsky ..... A47F 5/00 211/123
2,290,468 A * 7/1942 Godfrey ..... A47K 10/04 211/123
2,546,720 A * 3/1951 Brothers ..... A47G 25/746 211/123
D163,637 S * 6/1951 Roop ..... D6/563
D165,553 S * 12/1951 Schoor ..... 211/123
2,763,377 A * 9/1956 Martin ..... A47J 47/16 211/73
2,964,196 A * 12/1960 Phillips ..... A47G 25/746 211/123
3,145,031 A * 8/1964 Wilkinson ..... A01G 1/12 211/70.6
3,536,286 A * 10/1970 Kramer ..... A47G 25/06 211/106.01

(Continued)

*Primary Examiner* — Jennifer E. Novosad
(74) *Attorney, Agent, or Firm* — Duane Morris LLP; J. Rodman Steele, Jr.; Gregory M. Lefkowitz

(57) ABSTRACT

A multifunction support system includes a longitudinal support section extending along a first longitudinal axis. A first mounting section extends substantially along a second longitudinal axis. The first mounting section is coupled to a first end of the longitudinal support section. A second mounting section extends substantially along the second longitudinal axis and is coupled to a second end of the longitudinal support section. The second longitudinal axis is parallel to and spaced apart from the first longitudinal axis. The first and second mounting sections are coupled to a surface such that the longitudinal support section and the surface define a channel sized and configured to receive a coupling element therethrough.

20 Claims, 22 Drawing Sheets

(56) References Cited

U.S. PATENT DOCUMENTS 4,264,013 A * 4/1981 Vollmer ..... A47G 29/08 211/85.2
4,923,202 A * 5/1990 Breveglieri ..... B62B 3/10 108/107
4,932,576 A * 6/1990 Ashley ..... A45F 5/02 224/231
D328,681 S * 8/1992 Radosevich ..... D6/567
5,395,023 A * 3/1995 Naymark ..... A45C 11/38 224/199
5,511,705 A * 4/1996 Dreszer ..... A45F 5/02 224/582
5,722,576 A * 3/1998 Rogers ..... A45F 5/02 224/195
5,881,891 A * 3/1999 Murphy, Jr. ..... A47L 13/51 211/65
5,971,242 A * 10/1999 Schuerman ..... B60R 11/0241 224/539
6,213,365 B1 * 4/2001 Stocke ..... A41D 13/0012 224/223
6,666,465 B2 * 12/2003 Chan ..... B62B 1/12 211/70.6
6,698,632 B1 * 3/2004 Turner, Jr. ..... A45F 5/021 224/196
6,874,624 B2 * 4/2005 Redzisz ..... A45C 11/00 190/126
7,090,075 B1 * 8/2006 Rocha ..... A63L 355/00 206/315.2
7,322,482 B2 * 1/2008 Caradonna ..... A47B 73/004 211/74
7,686,196 B2 * 3/2010 Panosian ..... A45F 5/02 224/269
7,699,197 B2 * 4/2010 Panosian ..... A45F 5/02 224/271
7,726,495 B1 * 6/2010 Merbeth ..... A47G 1/12 211/87.01
7,762,440 B2 * 7/2010 Cook ..... F41C 33/046 2/338
8,267,260 B2 * 9/2012 Zhang ..... A47D 15/00 190/109
8,510,868 B2 * 8/2013 Mongan ..... F41C 33/046 2/300
9,038,869 B2 * 5/2015 Moreau ..... A45F 5/02 224/162
2002/0170933 A1 * 11/2002 Martin ..... A45F 5/02 224/197
2003/0141329 A1 * 7/2003 Huang ..... A45F 5/02 224/197
2005/0247653 A1 * 11/2005 Brooks ..... A47F 5/0846 211/94.01
2006/0237509 A1 * 10/2006 Moore, Sr. ..... A45F 3/14 224/675
2008/0142462 A1 * 6/2008 Whyzel ..... A47K 17/022 211/123
2008/0179370 A1 * 7/2008 Williams ..... A45C 13/02 224/682
2008/0185353 A1 * 8/2008 Immerman ..... A47K 10/04 211/16
2009/0145789 A1 * 6/2009 Panosian ..... B25H 3/00 206/373
2009/0145866 A1 * 6/2009 Panosian ..... A47F 5/0838 211/85.15
2014/0075650 A1 * 3/2014 Garrison ..... A45F 5/021 2/300
2017/0266804 A1 * 9/2017 Kinskey ..... B65D 33/14

* cited by examiner

MULTIFUNCTION TOOL BAR

CROSS-REFERENCE TO RELATED APPLICATION

This application claims benefit to U.S. Provisional Application Ser. No. 62/308,571, filed on Mar. 15, 2016, and entitled "MULTIFUNCTION TOOL BAR," the disclosure of which is incorporated herein in its entirety.

BACKGROUND

A variety of belts, bags, and carriers have been used for holding and transporting tools. Tool belts and hangers have also been used so that tools can be transported while leaving the hands of the wearer free to perform other functions. As always, there remains the opportunity to develop improved tool storage systems.

BRIEF DESCRIPTION OF THE FIGURES

The features and advantages of the present invention will be more fully disclosed in, or rendered obvious by the following detailed description of the preferred embodiments, which are to be considered together with the accompanying drawings wherein like numbers refer to like parts and further wherein.

Figure 1:
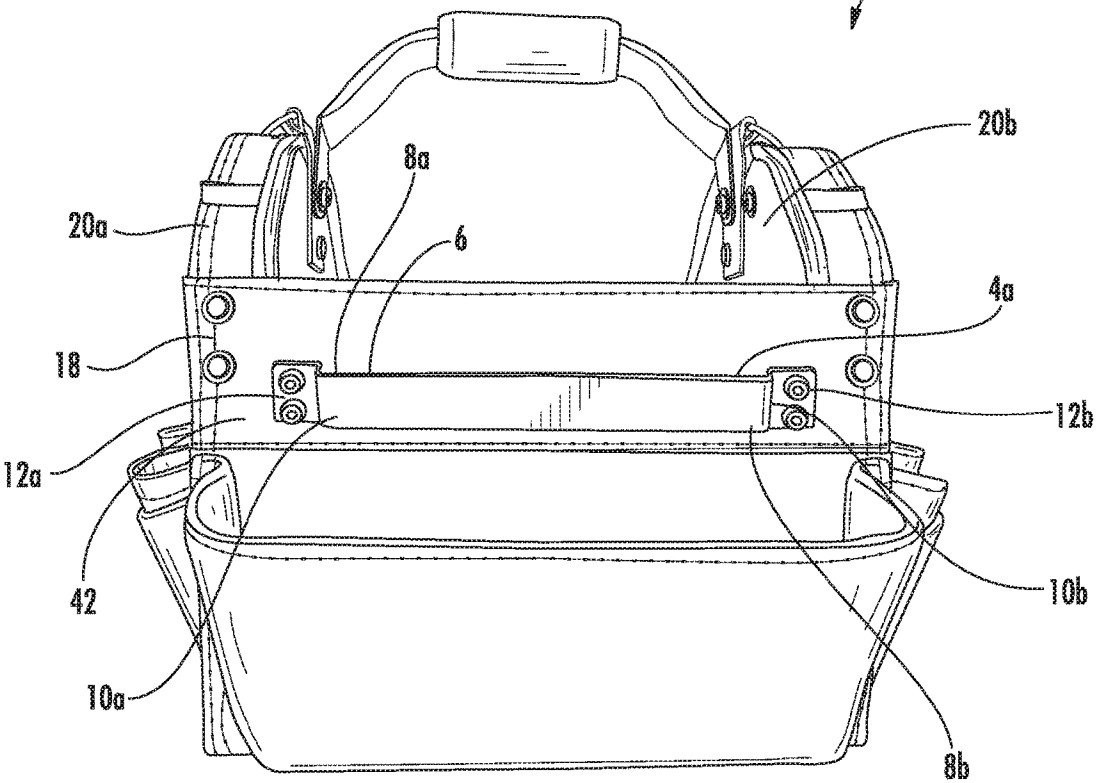
FIG. 1 is a front view of a tool pouch having at least one multifunction support bar coupled thereto, in accordance with some embodiments.
Figure 2:
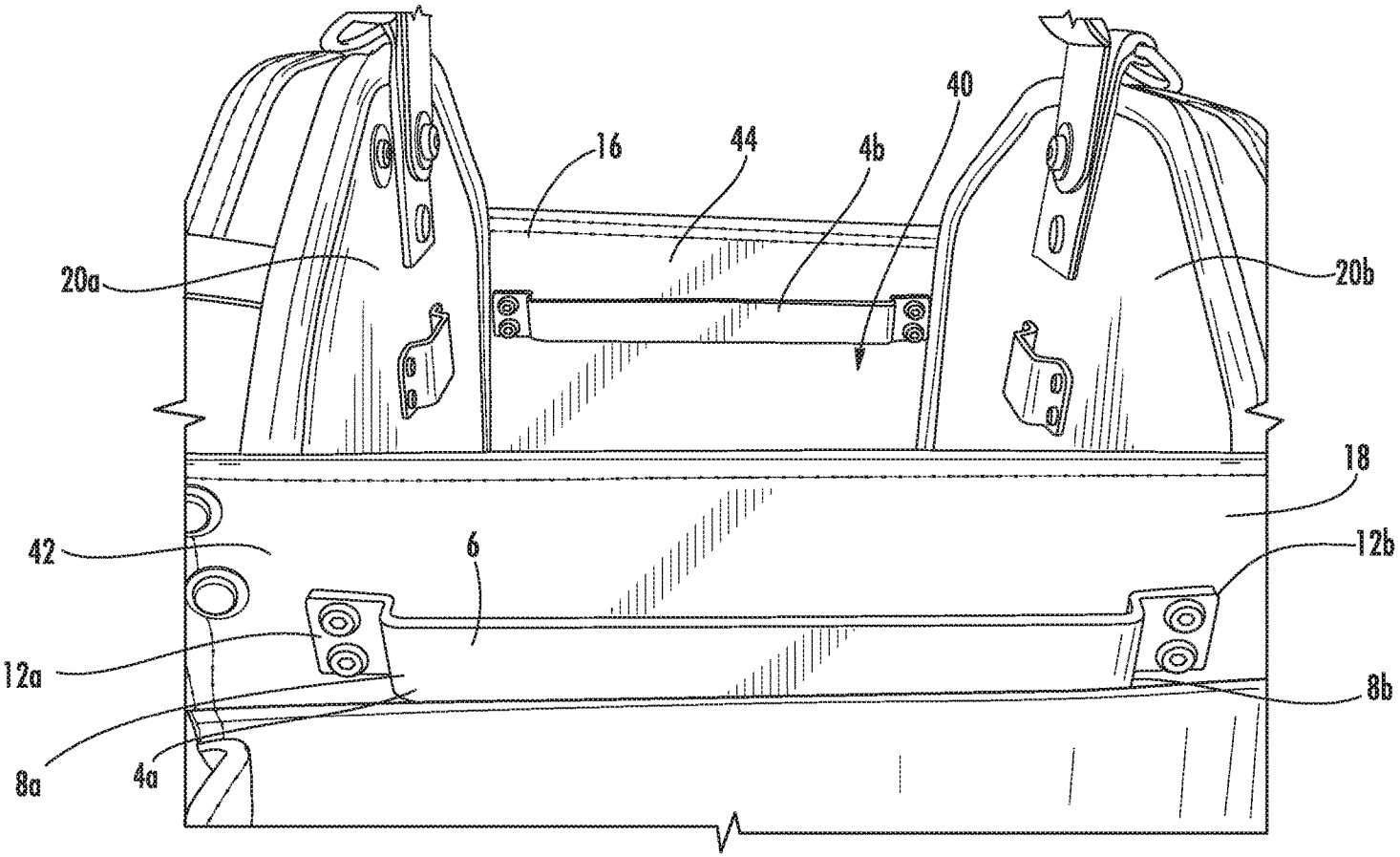
FIG. 2. is a detailed front perspective view of the tool pouch of FIG. 1.
Figure 3:
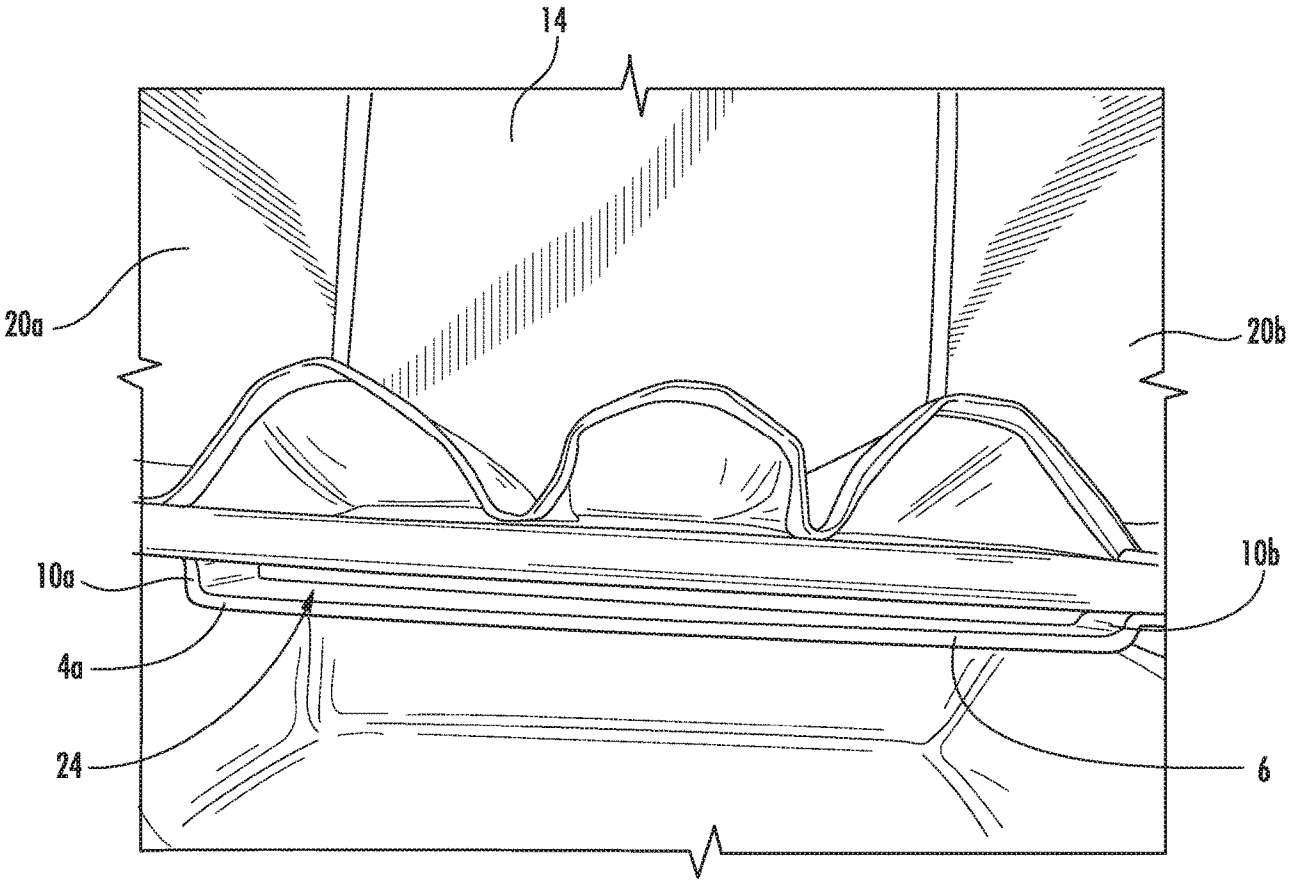
FIG. 3 is a detailed top view of a back wall of the tool pouch of FIG. 1.
Figure 4:
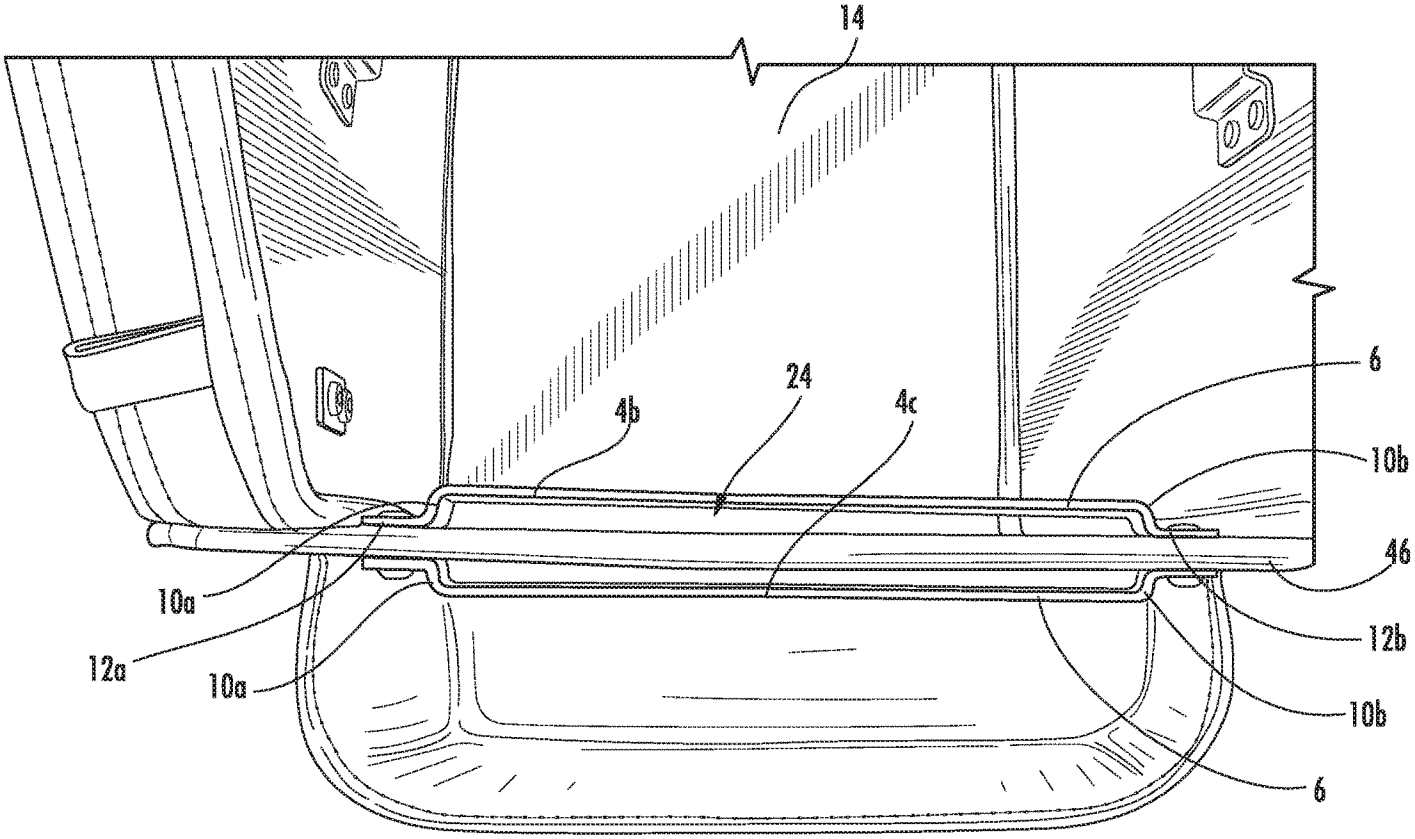
FIG. 4 is a detailed top view of a front wall of the tool pouch of FIG. 1.
Figure 5:
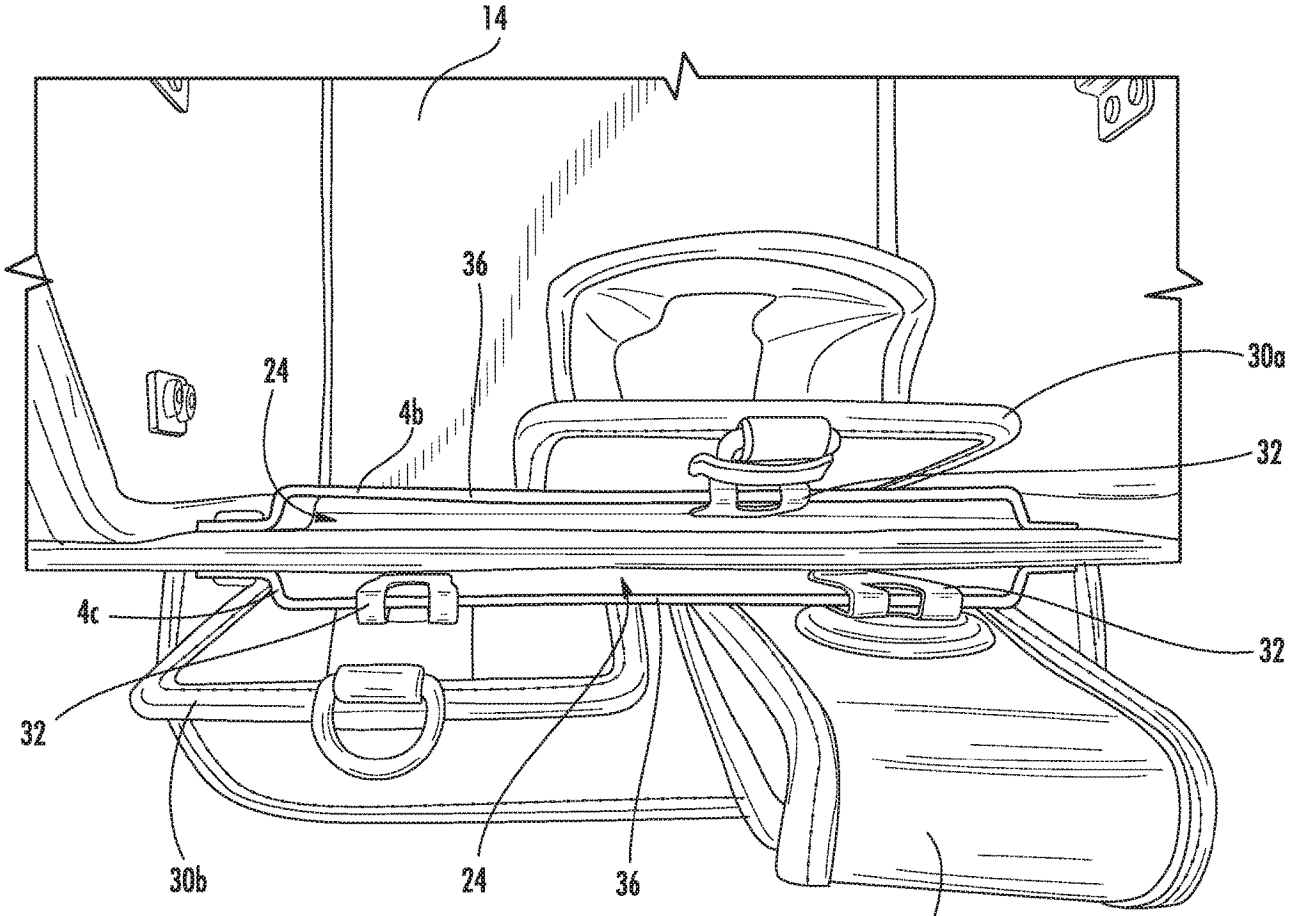
FIG. 5 is a detailed top view of the tool pouch of FIG. 1, having a plurality of accessory pouches coupled thereto.
Figure 6:
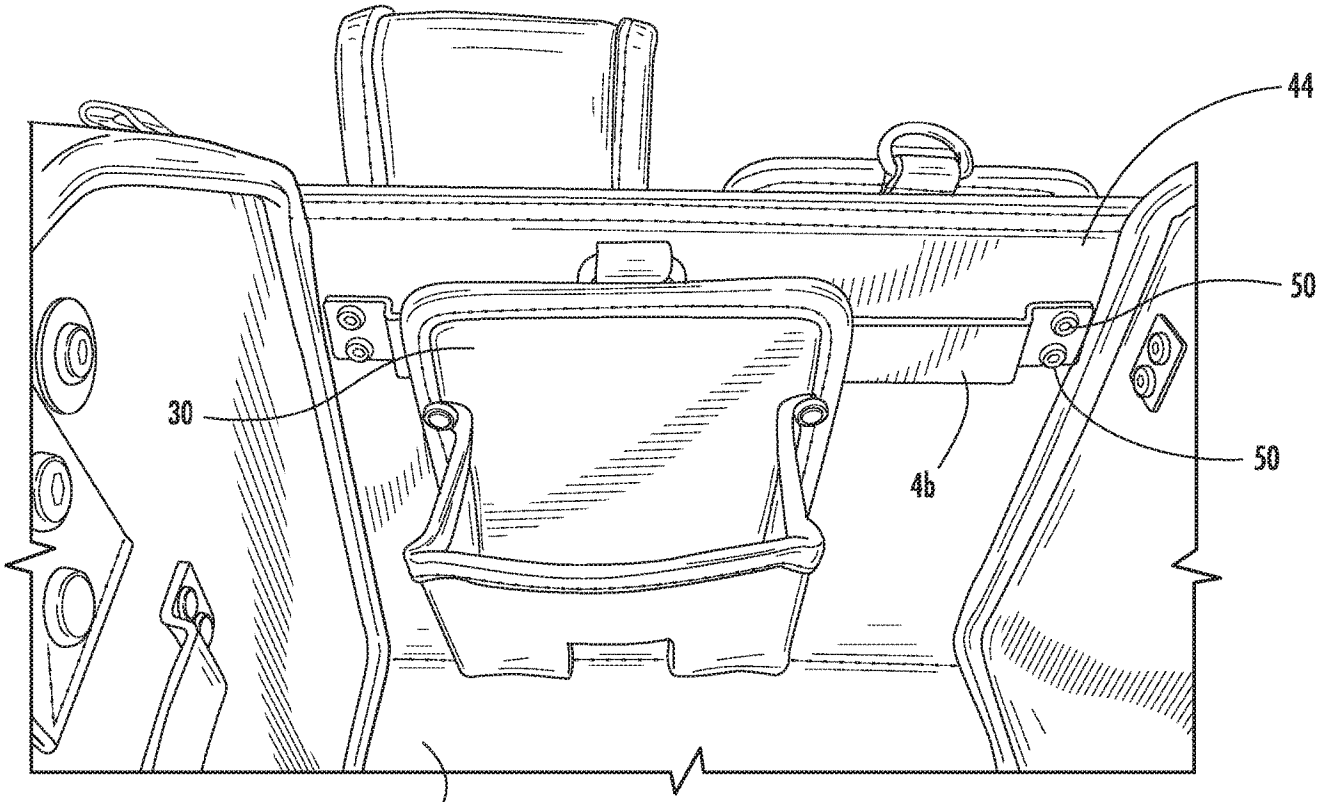
FIG. 6 is a detailed top perspective view of an inner cavity of the tool pouch of FIG. 1 having a multifunction support bar therein.

While the present disclosure is susceptible to various modifications and alternative forms, specific embodiments have been shown by way of example in the drawings and will be described in detail herein. It should be understood, however, that the present disclosure is not intended to be limited to the particular forms disclosed. Rather, the present disclosure is to cover all modifications, equivalents, and alternatives falling within the spirit and scope of the disclosure as defined by the appended claims.

DETAILED DESCRIPTION

The description of the preferred embodiments is intended to be read in connection with the accompanying drawings, which are to be considered part of the entire written description of this invention. The drawing figures are not necessarily to scale and certain features of the invention may be shown exaggerated in scale or in somewhat schematic form in the interest of clarity and conciseness. In this description, relative terms such as "horizontal," "vertical," "up," "down," "top," "bottom," as well as derivatives thereof (e.g., "horizontally," "downwardly," "upwardly," etc.) should be construed to refer to the orientation as then described or as shown in the drawing figure under discussion. These relative terms are for convenience of description and normally are not intended to require a particular orientation. Terms including "inwardly" versus "outwardly," "longitudinal" versus "lateral" and the like are to be interpreted relative to one another or relative to an axis of elongation, or an axis or center of rotation, as appropriate. Terms concerning attachments, coupling and the like, such as "connected" and "interconnected," refer to a relationship wherein structures are secured or attached to one another either directly or indirectly through intervening structures, as well as both movable or rigid attachments or relationships, unless expressly described otherwise, and includes terms such as "directly" coupled, secured, etc. The term "operatively coupled" is such an attachment, coupling, or connection that allows the pertinent structures to operate as intended by virtue of that relationship.

In various embodiments, a multifunction support bar is disclosed. The multifunction support bar is configured to be coupled to at least a first surface to support one or more tools, accessory pouches, and/or other accessories. The multifunction support bar includes a longitudinal support section extending along a first longitudinal axis. A first offset section is coupled to a first end of the longitudinal support section and a second offset section is coupled to a second end of the longitudinal support section. The first and second offset sections extend from the longitudinal support section at a predetermined angle. A first mounting section is coupled to and extends from the first offset section and a second mounting section is coupled to and extends from the second offset section. The first and second mounting sections extend longitudinally along a second longitudinal axis that is parallel to, but spaced apart from, the first longitudinal axis. The offset portions determine a predetermined planar offset between the longitudinal support section and the mounting sections.

FIGS. 1-6 illustrate one embodiment of a tool carrier 2 having at least one multifunction support bar 4*a*-4*c* coupled thereto. The tool carrier 2 can include a base 14, a back wall 16, a front wall 18, and first and second side walls 20*a*, 20*b*. The back wall 16, front wall 18, and first and second side walls 20*a*, 20*b* are coupled to the base 14. The side walls 20*a*, 20*b* are coupled to the front wall 18 and the back wall 16. The base 14, back wall 16, front wall 18, and side walls 20*a*, 20*b* define a storage volume 40. A first multifunction support bar 4*a* is coupled to an outer portion 42 of the front wall 18. The first multifunction support bar 4*a* can be centered on the front wall 16 and/or offset with respect to a center point of the front wall 18. In some embodiments, a second multifunction support bar 4*b* can be coupled to an inner surface 44 of the back wall 16 and a third multifunction support bar 4*c* can be coupled to an outer surface 46 of the back wall 16. Although embodiments having specific positions and/or orientations of multifunction support bars 4*a*-4*c* are discussed herein, it will be appreciated that a multifunction support bar 4*a*-4*c* can be coupled to a tool pouch at any suitable position and/or orientation.

In some embodiments, each of the multifunction support bars 4*a*-4*c* include a longitudinal support section 6 extending substantially along a first longitudinal axis. A first offset section 10*a* is coupled to a first end 8*a* of the longitudinal support section 6 and a second offset section 10*b* is coupled to a second end 8*b* of the longitudinal support section 6. The offset sections 10*a*, 10*b* extend from the ends 8*a*, 8*b* of the longitudinal support section at a predetermined angle Θ with respect to the first longitudinal axis. For example, in some embodiments, the predetermined angle Θ is substantially between 90-180°, such as, 90°, 120°, 135°, 150°, 165° and/or any other suitable angle or range defined by the foregoing.

A first mounting portion 12*a* extends from the end of the first offset portion 10*a* and a second mounting portion 12*b* extends from the end of the second offset portion 10*b*. The first and second mounting portions 12*a*, 12*b* extend substantially longitudinally along a second longitudinal axis that is parallel to, but spaced apart from, the first longitudinal axis. The offset portions 10*a*, 10*b* position the longitudinal support section 6 at a predetermined planar offset with respect to the first and second mounting portions 12*a*, 12*b*. The predetermined planar offset is determined by the length of the offset portions 10*a*, 10*b* and the predetermined angle between the longitudinal support section 6 and the offset portions 10*a*, 10*b*. As discussed in more detail below, the predetermined planar offset defines a channel between the longitudinal support section 6 and a planar surface to which the multifunction support bar 4*a*, 4*b*, 4*c* is attached (such as a wall 16, 18 of the tool carrier 2).

In some embodiments, the longitudinal support section 6, first and second offset portions 10*a*, 10*b*, and/or the first and second mounting portions 12*a*, 12*b* have a predetermined height and width for receiving one or more tools, clips, and/or other accessories. For example, in some embodiments, each portion of the multifunction support bar 4*a*-4*c* has a height of about 1" and a width of about ¼". For example, the height can range from about ½" to about 5" or any range defined by any two heights selected from 1, 1.5, 2, 2.5, 3, 35, 4, or 4.5". Similarly, a width can range from about 0.1" to about 1.5" or any range defined by any two widths selected from 0.1, 0.125, 0.1875, 0.25, 0.375, 0.5, 0.625, 0.75, 1, 1.25, or 1.5", although it will be appreciated that the multifunction support bars 4*a*-4*c*, and/or any portion thereof, can have larger or smaller dimensions. The multifunction support bars 4*a*-4*c* are each configured to receive a portion of one or more tools and/or mounting devices between the longitudinal support section 6 and a wall 16, 18 of the tool carrier 2.

In some embodiments, the tool carrier 2 includes a plurality of multifunction support bars 4*a*-4*c* coupled at various positions of the tool carrier 2. The mounting portions 12*a*, 12*b* of each of the multifunction support bars 4*a*-4*c* are flush with a surface 42-46 of the tool carrier 2. The offset sections 10*a*, 10*b* offset the longitudinal support section 6 from the surfaces 42-46 at a predetermined spacing to define a slot 24. For example, in the illustrated embodiment, the tool carrier 2 includes a first multifunction support bar 4*a* coupled to an outer surface 42 of the front wall 16, a second multifunction support bar 4*b* coupled to an inner surface 44 of the back wall 14, and a third multifunction support bar 4*c* coupled to an outer surface 46 of the back wall 14. Each of the multifunction support bars 4*a*-4*c* define a slot 24 having a predetermined width between the surface 42-46 and the multifunction support bar 4*a*-4*c*. The predetermined width is equal to the predetermined offset between the mounting portions 12*a*, 12*b* and the longitudinal support section 6 of each of the multifunction support bars 4*a*-4*c*. The offset can be a planar/parallel offset. Each of the slots 24 can have similar and/or different spacing defined between the surface 42-46 and the longitudinal support section 6.

The multifunction support bars 4*a*-4*c* can be coupled to the tool carrier 2 by any suitable fastener. For example, in some embodiments, the multifunction support bars 4*a*-4*c* define one or more holes 50 through the mounting portions 12*a*, 12*b* thereof. The one or more holes 50 are sized and configured to receive a fastener, such as, for example, a rivet, a screw, a nail, a bolt, and/or any other suitable fastener. Fasteners are inserted through and/or into the one or more holes 50 and the carrier 2 to secure the multifunction support bar 4*a*-4*c* in a fixed position with respect to the tool carrier 2.

The slot 24 defined between each surface 42-46 and respective multifunction support bar 4*a*-4*c* attached thereto is sized and configured to receive one or more tools and/or retention mechanisms therein. For example, in some embodiments, a plurality of accessory pouches 30*a*-30*c* are coupled to one or more of the multifunction support bars 4*b*, 4*c*. The accessory pouches 30*a*-30*c* can be coupled to the multifunction support bar 4*a*-4*c* by any suitable coupling mechanism, such as, for example, one or more clips, straps, pins, rivets, and/or any other suitable coupling mechanism. In the illustrated embodiment, each of the accessory pouches 30*a*-30*c* are coupled to the multifunction support bars 4*a*-4*c* by a clip 32. A portion of each clip 32 extends over a top edge 36 of the longitudinal support section 6 and secures each of the accessory pouches 30*a*-30*c* to the multifunction support bar 4*b*, 4*c*.

In some embodiments, the slot 24 is sized and configured to receive at least a portion of a tool therein. For example, in some embodiments, the offset of the longitudinal support section 6 is selected such that the slot 24 is sized and configured to allow a working portion of a tool, such as a screwdriver shaft, a rasp head, a blade of putty knife, etc., to fit through while preventing a handle of the tool from passing there through. The handle of such a tool rests on the top edge 36 of the longitudinal support section 6 when supported by the multifunction support bar 4*a*-4*c*. For example, in some embodiments, the slot 24 defines a width in a range from about 3/16" to about 3/4", such as any range defined by any two widths selected from 3/16", 1/4", 5/16", 3/8", 7/16", 1/2", 9/16", 5/8", 11/16", 3/4", for example, 3/8", although it will be appreciated that a larger and/or smaller slot widths can be selected for larger and/or smaller tools and handles. In some embodiments, the tools are slidably received within the slot 24.

Figure 7:
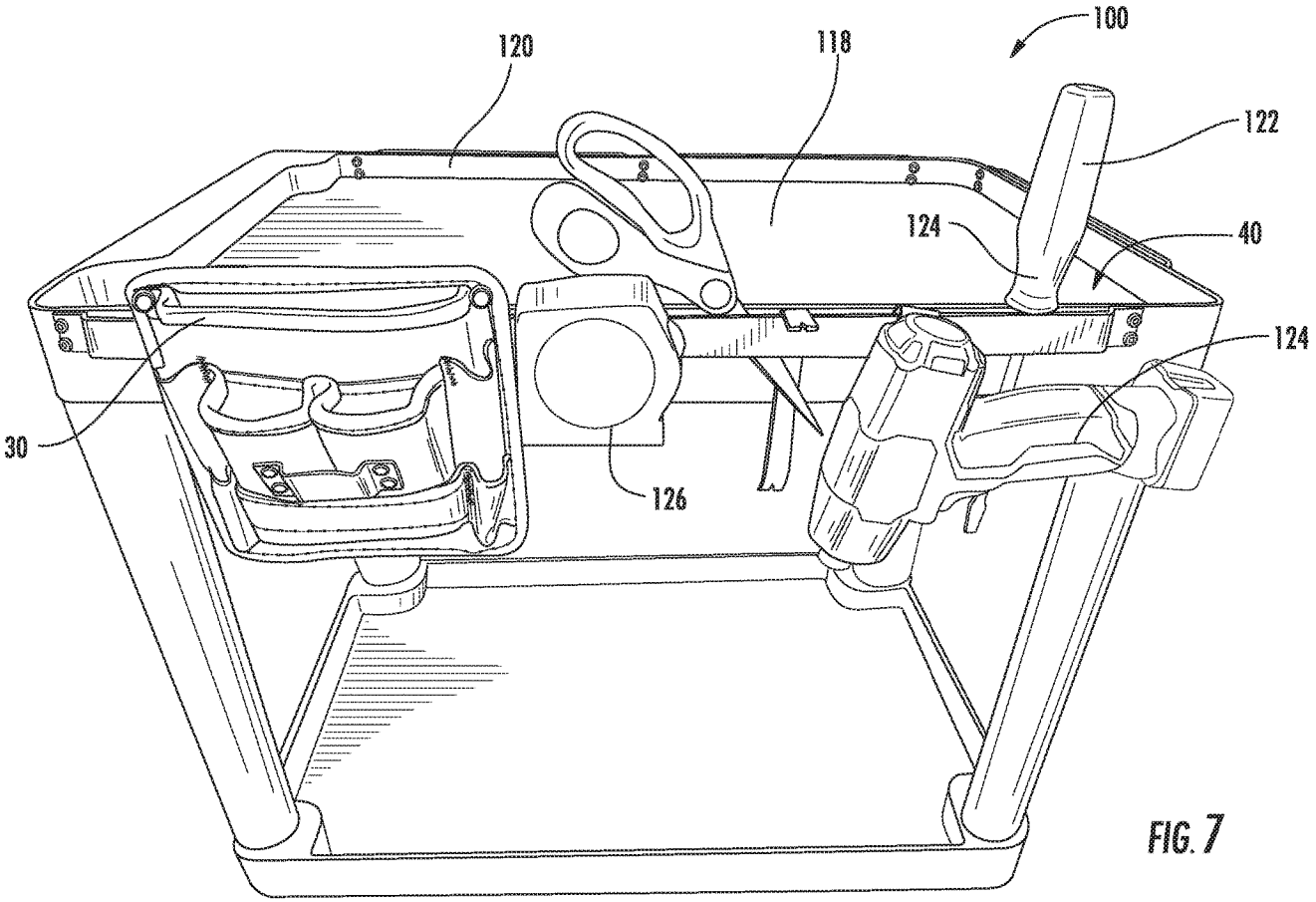
FIG. 7 is a side perspective view of a working structure having a multifunction support bar coupled thereto, in accordance with some embodiments.
Figure 8:
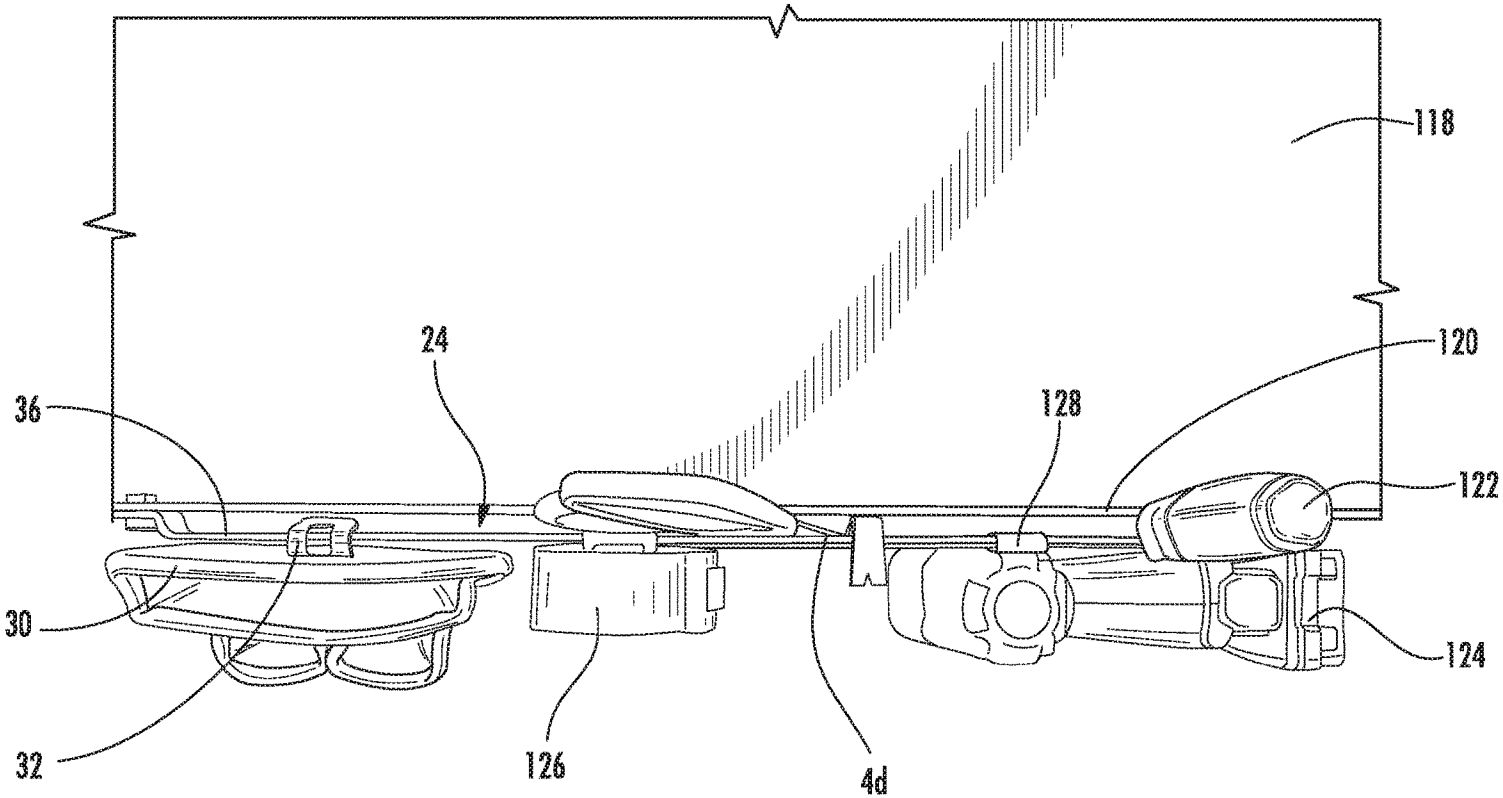
FIG. 8 is a detailed top view of the working structure of FIG. 7, having a plurality of tools coupled to the multifunction support bar.
Figure 9:
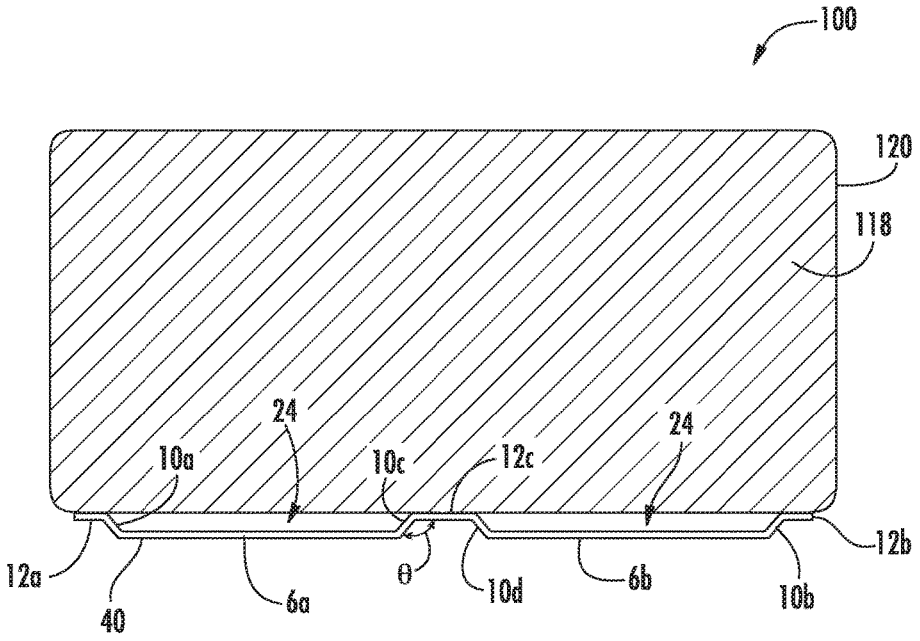
FIG. 9 is a top perspective view of the working structure of FIG. 7.

As illustrated in FIGS. 7-9, in some embodiments, a multifunction support bar 4 can be coupled to a working structure 100, such as, for example, a cart, a work bench, a tool bench, and/or any other suitable working structure 100. The structure 100 includes a working surface 118 having a perimeter wall 120 coupled to an edge of the working surface 118. At least one multifunction support bar 4*d* is coupled to the perimeter wall 120. The multifunction support bar 4*d* is similar to the multifunction support bars 4*a*-4*c* described above and similar description is not repeated herein. The multifunction support bar 4*d* is configured to support one or more accessory pouches 30, tools, and/or other accessories thereon.

The multifunction support bar 4*d* and the perimeter wall 120 define a slot 24 there between. The slot 24 has a width sized and configured to receive at least a portion of a mounting device and/or a working portion of a tool therethrough. For example, in some embodiments, one or more accessory pouches 30 are coupled to the multifunction support bar 4 using one or more clips 32, as described above. As shown in FIG. 8, in some embodiments, a working portion of a tool (such as screwdriver 122) is inserted through the slot 24. A handle portion 124 of the tool 122 contacts and is supported by a top edge 36 of the multifunction support bar 4. The tool 122 is retained within the receiving slot 24 by the longitudinal support section 6 of the multifunction support bar 4. In other embodiments, as shown in FIG. 8, a tool (such as a drill 124 or tape measure 126) includes a retaining clip 128. The retaining clip 128 is sized and configured to be placed over a top edge 36 of the multifunction support bar 4*d* and retain the tool 124,126 thereon.

In some embodiments, as shown in FIG. 9, a multifunction support bar 4*d* can include a mid-mounting section 12*c*. The mid-mounting section 12*c* can be included on a multifunction support bar 4*d* to provide one or more additional coupling points between the multifunction support bar 4*d* and an opposing surface such as, for example, perimeter wall 120. In some embodiments, the mid-mounting section 12*c* is located between a first longitudinal support section 6*a* and a second longitudinal support section 6*b* and has the same predetermined planar offset as the first and second mounting sections 12*a*, 12*b*. The mid-mounting section 12*c* is coupled to the first and second longitudinal support sections 6*a*, 6*b* by a third offset section 10*c* and a fourth offset section 10*d*. Although a single mid-mounting section 12*c* is illustrated, it will be appreciated that additional mid-mounting sections 12*c* can be included to provide additional connection points between the multifunction support bar 4*d* and the perimeter wall 120. Although the figures show a number of different embodiments, it will be understood that the features and elements described with respect to one embodiment can be incorporated into the other embodiment. It should also be understood that the multifunction support bar 4*d* of FIGS. 7-9 functions identically to the multifunction support bar 4*a*-4*c* of FIGS. 1-6, especially as to attachment and storage of tools.

FIGS. 10-21 illustrate embodiments of accessory pouches 200*a*-300*d* configured to couple to one or more of the multifunction support bars 4*a*-4*d* discussed herein. Each of the accessory pouches 200*a*-300*d* discussed herein includes various features and elements that can be incorporated into other embodiments of the accessory pouches 200*a*-300*d*. The accessory pouches 200*a*-300*d* are similar to the accessory pouch 30 discussed above, and similar description is not repeated herein. In various embodiments, one or more pockets, holders, containers, and/or other devices are coupled to a backing 202, 302 of the accessory pouch 200*a*-300*d* by one or more fasteners. For example, in some embodiments, rivets 258 couple one or more pockets, containers, etc. to the backing 202, 302, although it will be appreciated that any suitable fastener can be used.

The backing 202, 302 of each of the accessory pouches 200*a*-300*d* has a predetermined length and width. For example, each of a first set of accessory pouches 200*a*-200*f* has a predetermined length and a first predetermined width and each of a second set of accessory pouches 300*a*-300*d* has a predetermined length and a second predetermined width. The second predetermined width can be greater than the first predetermined width. Although specific embodiments are illustrated herein, it will be appreciated that each of the accessory pouches 200*a*-300*d* can have any suitable dimensions.

Figure 16:
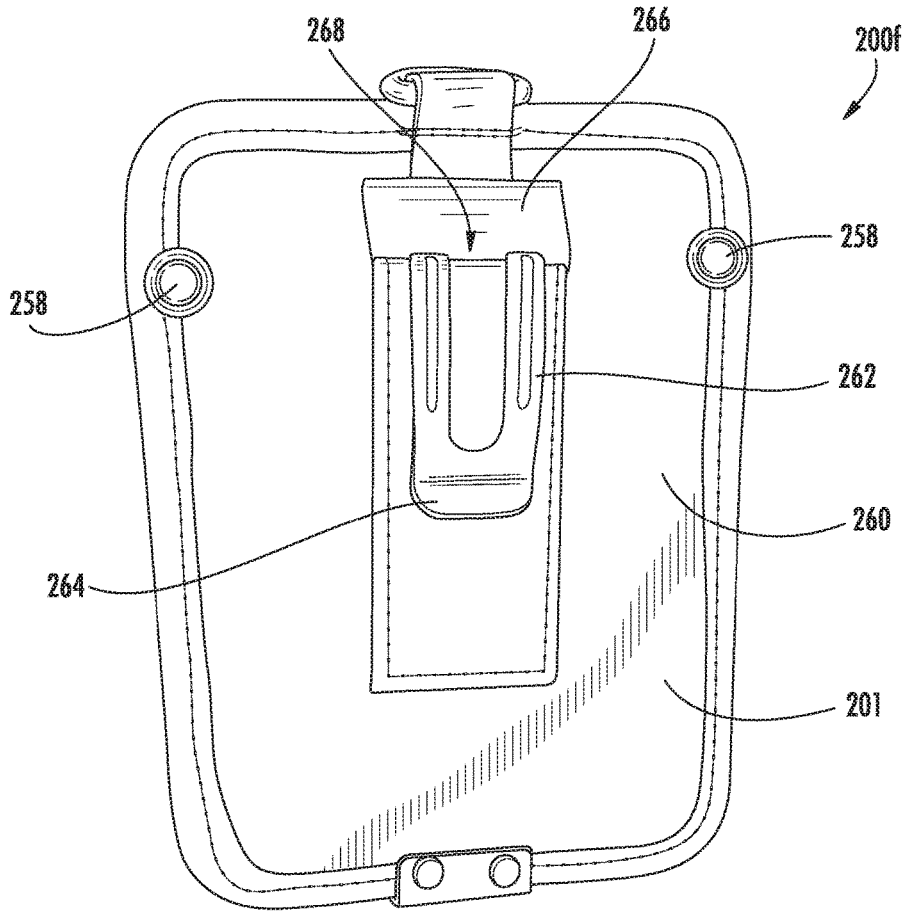
FIG. 16 is a rear view of an accessory pouch including a clip for coupling the accessory pouch to a multifunction support bar, in accordance with some embodiments.
Figure 21:
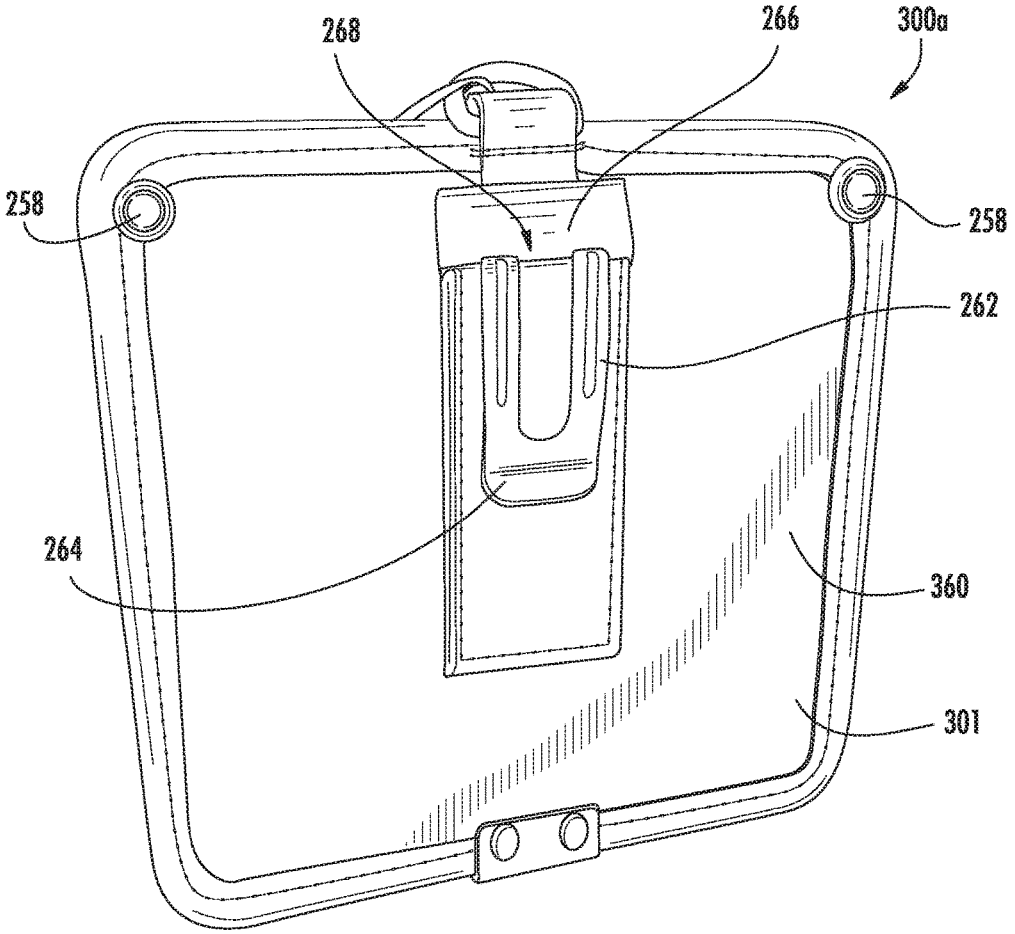
FIG. 21 is a rear view of an accessory pouch including a clip for coupling the accessory pouch to a multifunction support bar, in accordance with some embodiments.

FIGS. 16 and 21 are rear views of accessory pouches 200, 300 each including a clip 262 for coupling the accessory pouch 200, 300 to a multifunction support bar, in accordance with some embodiments. The accessory pouch 200, 300 includes a rear surface 260. The clip 262 is coupled to the rear surface 260 of the accessory pouch 200, 300 by any suitable coupling means. For example, in the illustrated embodiment, a fabric strip 266 is sewn to the rear surface 260 of the accessory pouch 200, 300. The fabric strip 266 defines a pocket 268 between a front portion 266*a* and a rear portion 266*b* of the fabric strip 266. The clip 262 is inserted into the pocket 268 and maintains a friction connection to the pocket 268. Although a specific embodiment is discussed herein, it will be appreciated that the clip 262 can be coupled to the rear surface 260 by any suitable means, such as, for example, one or more fasteners (e.g., rivets), a friction connection, adhesive, and/or any other suitable connection.

The clip 262 is configured to couple the accessory pouch 200, 300 to a multifunction support bar, such as the multifunction support bars 4*a*-4*d* discussed above. The clip 262 includes a fastening portion 264 sized and configured to be positioned over a multifunction support bar 4*a*-4*d* to maintain the accessory pouch 200, 300 thereon. The multifunction support bar 4*a*-4*d* is positioned between the fastening portion 264 and the rear surface 260 of the accessory pouch 200, 300. Although embodiments of the accessory pouch 200, 300 are discussed herein, it will be appreciated that the illustrated clip 262 can be coupled to any of the accessory pouches discussed herein, such as accessory pouches 200*a*-200*f*, 300*a*-300*d*.

Figure 22:
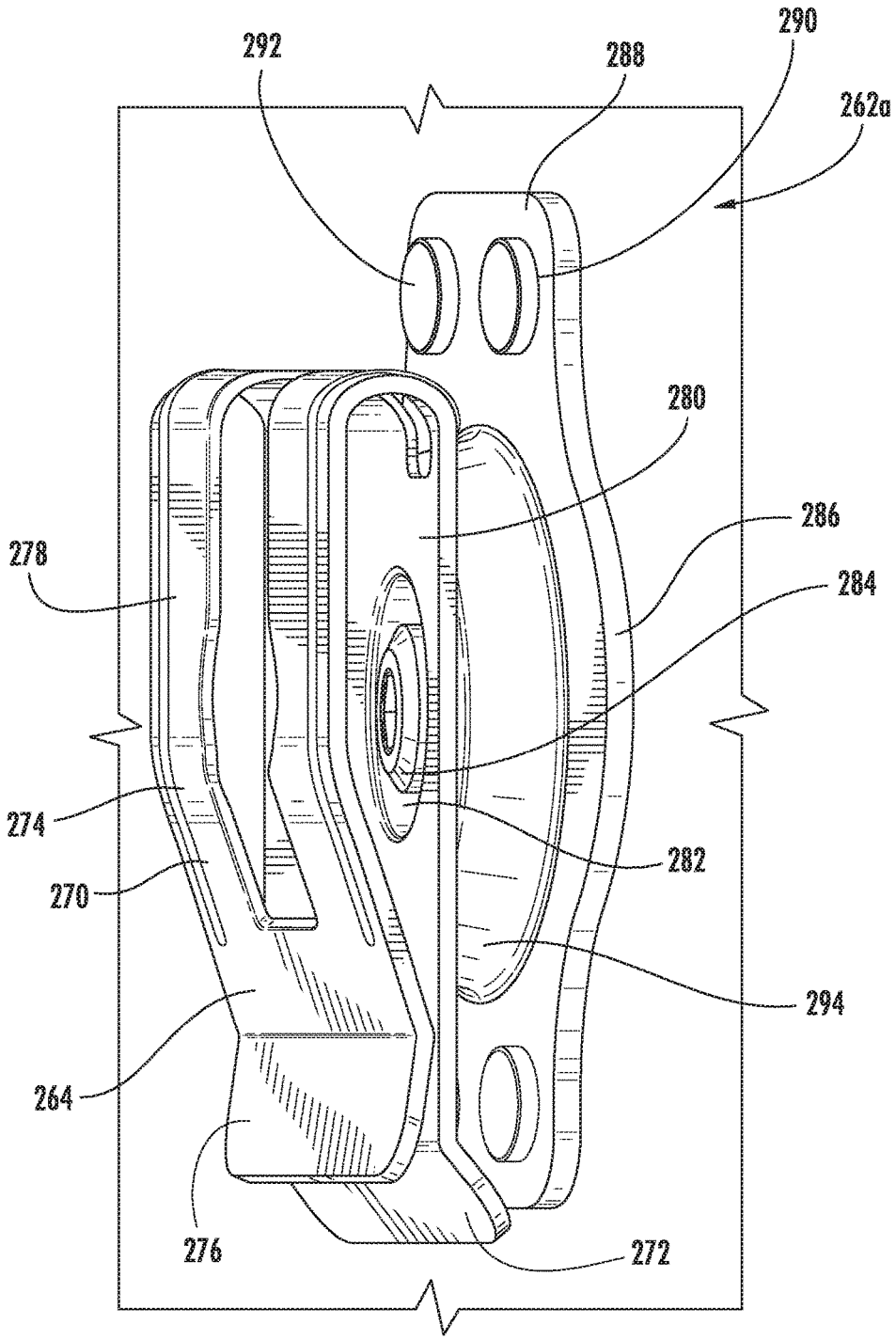
FIG. 22 is a detailed side perspective view of a rotatable clip configured to couple an accessory pouch to a multifunction support bar, in accordance with some embodiments.

In some embodiments, the clip 262 is rotatably coupled to the accessory pouch 200, 300. FIG. 22 illustrates a rotatable clip 262*a* configured to couple an accessory pouch 200, 300 to a multifunction support bar 4*a*-4*d*, in accordance with some embodiments. The rotatable clip 262*a* includes a front portion 270 having a first longitudinal section 276 coupled to a second longitudinal section 278 by an offset section 274. The offset section positions the first longitudinal section 276 out-of-plane of the second longitudinal section 278. The front portion 270 is coupled to a rear portion 272. The rear portion defines a hole 282 through a back surface 280. The hole 282 is sized and configured to receive a fastener 284. The fastener 285 rotatably couples the clip 262*a* to a base 286. The base 286 includes a body 288 defining one or more fastener holes 290. The one or more fastener holes 290 are sized and configured to receive one or more fasteners 292 therethrough to couple the clip 262*a* to a rear surface 260, 360 of the accessory pouch 300.

Figure 10:
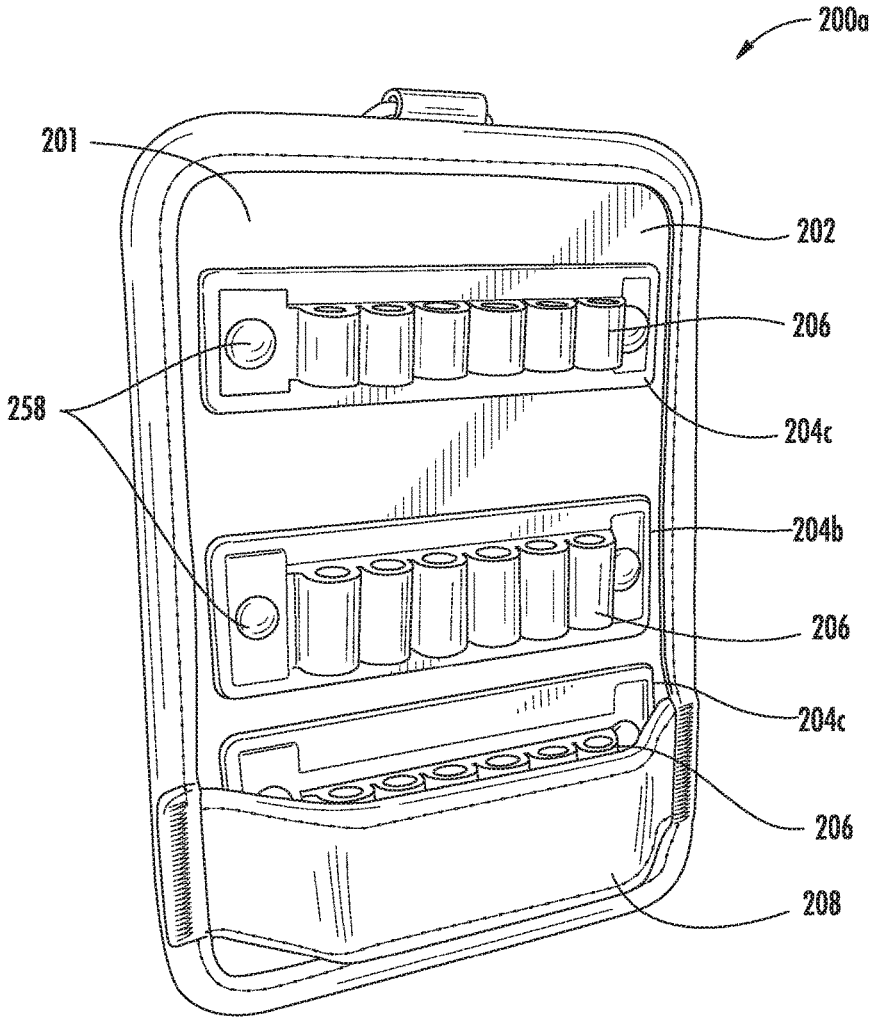
FIG. 10 is a front perspective view of an accessory pouch including a plurality of accessory holders, in accordance with some embodiments.

FIG. 10 illustrates an accessory pouch 200*a* having a plurality of tool holders 204*a*-204*c* coupled to a front face 202 of a support backing 201. Each of the tool holders 204*a*-204*c* includes a plurality of accessory receiving channels 206 extending therefrom. The accessory receiving channels 206 are sized and configured to receive at least a portion of an accessory therein. For example, in some embodiments, the accessory receiving channels 206 are sized and configured to receive one or more sockets therein. In other embodiments, the accessory receiving channels 206 are sized and configured to receive a working portion of a tool, such as a screwdriver, therethrough. The accessory receiving channels 206 can include a second end that is closed (defining a cup or container) and/or open (defining a channel). In some embodiments, a flexible accessory support 208 is coupled to a bottom portion of the front face 202. The flexible accessory support 208 is configured to support one or more accessories, such as a drill or other tool.

In some embodiments, the accessory holders 204*a*-204*c* and/or the flexible accessory support 208 are coupled to the support backing 201 by any suitable fasteners. For example, in the illustrated embodiments, one or more rivets 258 couple the accessory holders 204*a*-204*c* to the support backing 201 and a plurality of stitches couple the flexible accessory support 208 to the support backing 201. Although specific embodiments are illustrated herein, it will be appreciated that the accessory holders 204*a*-204*c* and/or the flexible accessory support 208 can be coupled to the support backing by any suitable fastener, such as, for example, a rivet, screw, bolt, stitched thread, glue, and/or any other suitable fastener.

Figure 11:
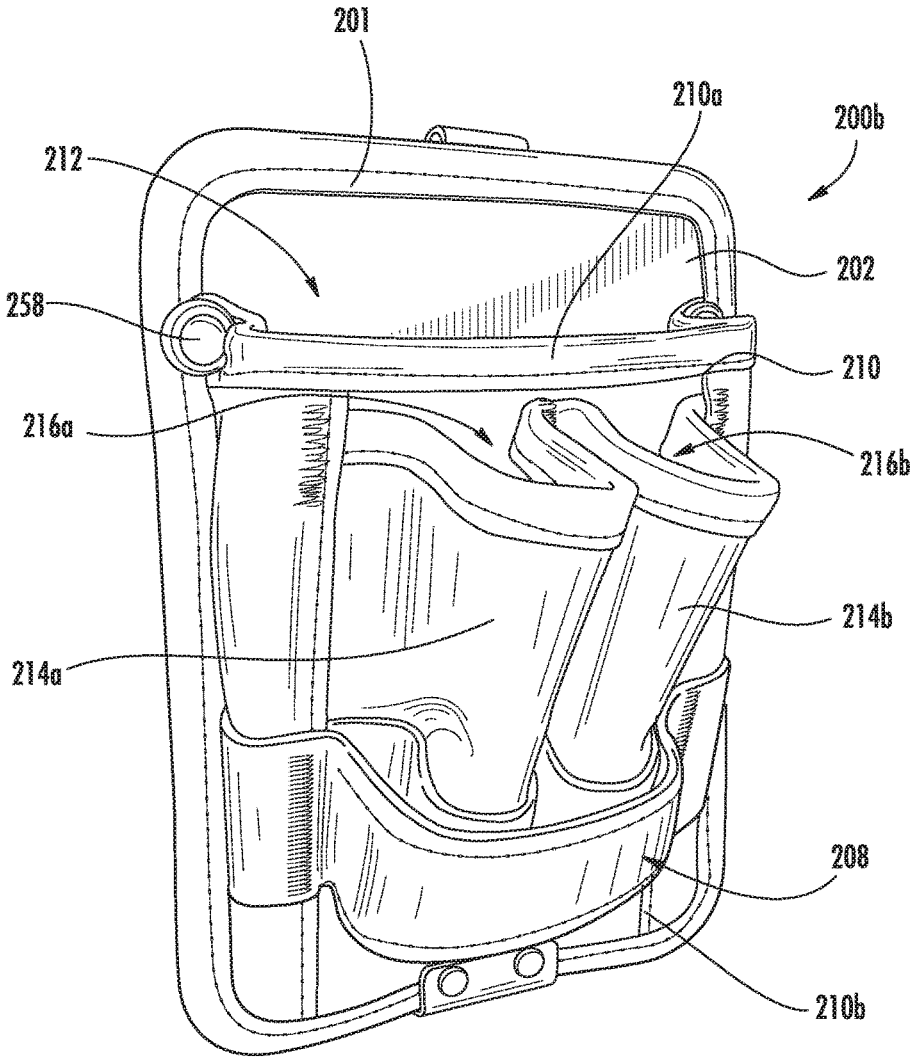
FIG. 11 is a front perspective view of an accessory pouch including a first pocket and a plurality of second pockets, in accordance with some embodiments.

FIG. 11 illustrates an accessory pouch 200*b* having a first pocket 210 coupled to a front face 202 of a support backing 201. The first pocket 210 and the front surface 202 of the support backing 201 define a space there between for receiving one or more accessories. The first pocket 210 defines an opening 212 between an upper edge 210*a* of the first pocket 210 and the support backing 201. A lower edge 210*b* is coupled to the support backing 201. In some embodiments, one or more second pockets 214 are coupled to an outer surface of the first pocket 210. The one or more second pockets 214 and the outer surface of the first pocket 210 define a space there between. An upper edge of the second pocket 214 defines an opening 216*a*, 216*b* configured to receive one or more tools and/or accessories therein. In some embodiments, the one or more second pockets 214 include closed second ends, although it will be appreciated that the second end can be at least partially open for receiving a portion of a tool or other accessory therethrough.

Figure 12:
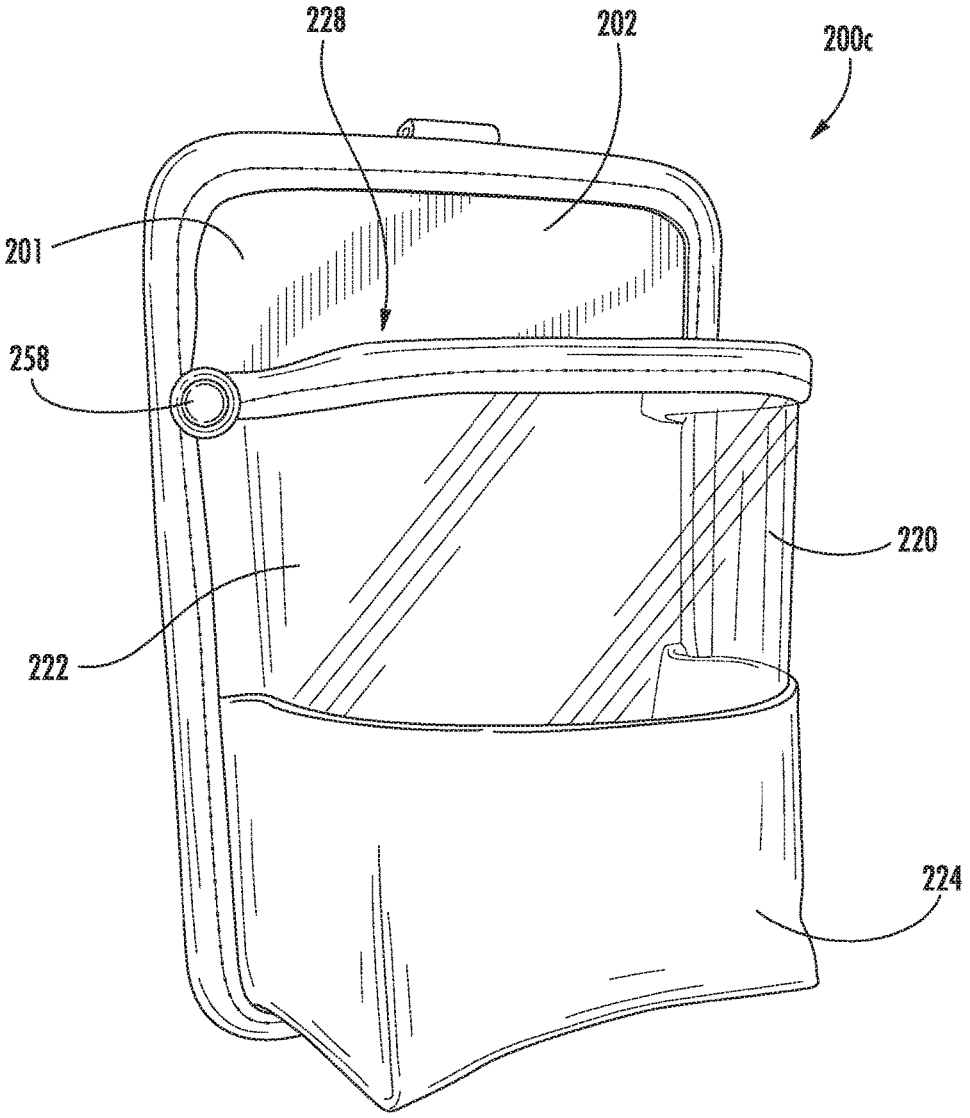
FIG. 12 is a front perspective view of an accessory pouch including a partially transparent accessory container, in accordance with some embodiments.

FIG. 12 is a front, perspective view of an accessory pouch 200*c* including a partially transparent accessory container 220, in accordance with some embodiments. The partially transparent accessory container 220 and the support backing 201 define a pocket or container having an open end 228 for receiving one or more accessories, such as screws, nails, etc., therein. The partially transparent accessory container 220 includes a transparent portion 222 and an opaque portion 224. The transparent portion 222 can be defined by any suitable material, such as, for example, a durable flexible plastic material.

Figure 13:
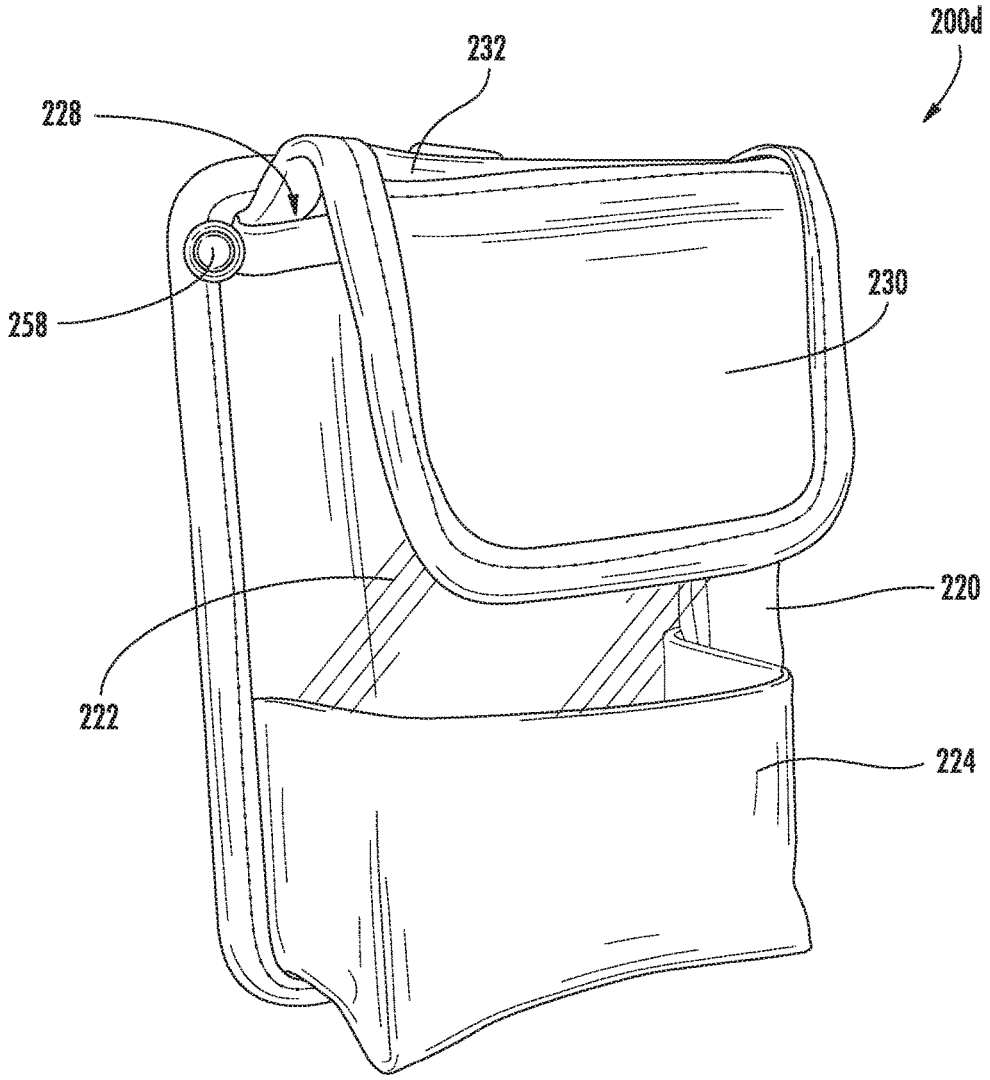
FIG. 13 is a front perspective view of an accessory pouch including a partially transparent accessory container including a flap, in accordance with some embodiments.

FIG. 13 is a front, perspective view of an accessory pouch 200*d* including a partially transparent accessory container 220 including a flap 230, in accordance with some embodiments. The partially transparent accessory container 220 is similar to the partially transparent accessory container 220 illustrated in FIG. 12, and similar description is not repeated herein. The accessory pouch 200*d* includes a flexible flap 230 configured to cover the pouch opening 228. In some embodiments, the flexible flap 230 includes a transparent section 232 and an opaque section 234. The transparent section 232 can be configured to extend at least partially over the opening 228. In some embodiments, the opaque section 234 extends at least partially over the transparent portion 222 of the partially transparent accessory container 220.

Figure 14:
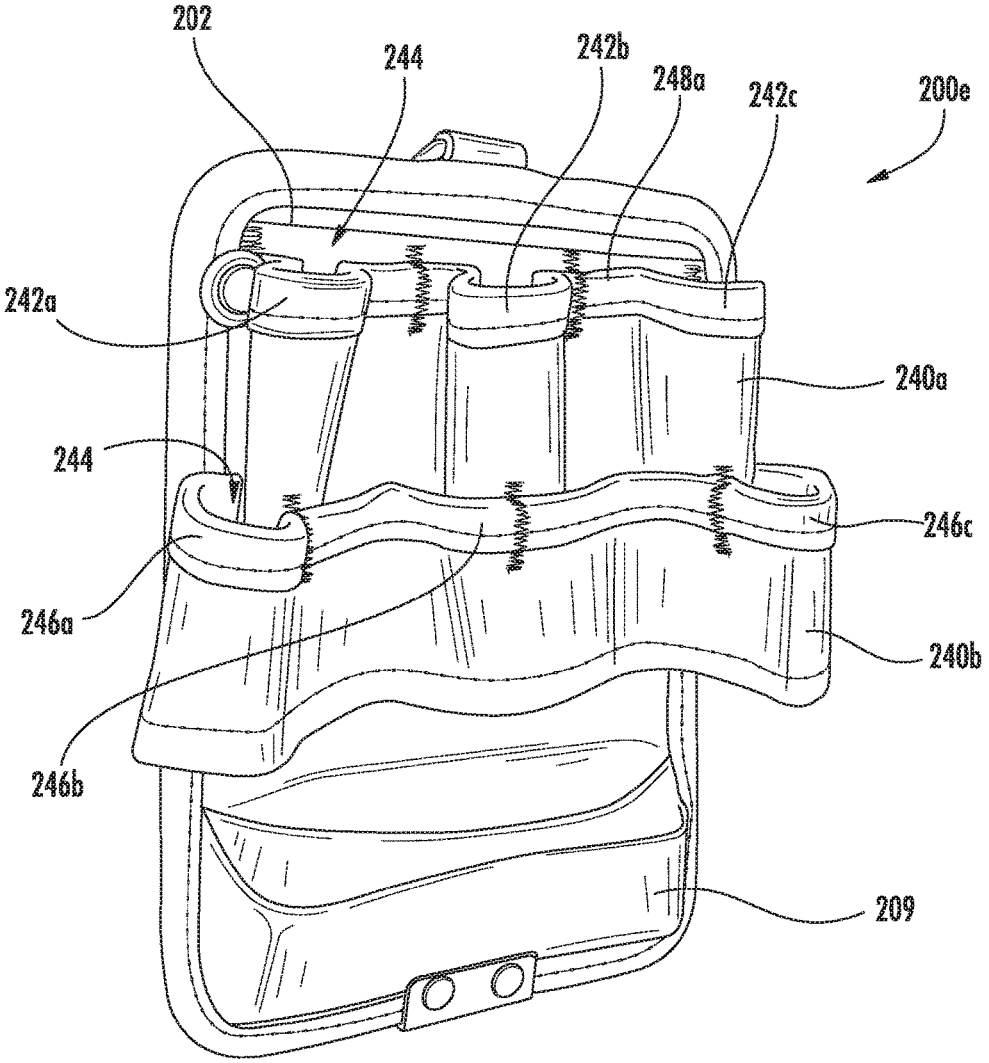
FIG. 14 is a front perspective view of an accessory pouch including a first plurality of pockets and a second plurality of pockets, in accordance with some embodiments.

FIG. 14 is a front, perspective view of an accessory pouch 200*e* including a first plurality of accessory holders 242*a*-242*c* and a second plurality of accessory holders 246*a*-246*c*, in accordance with some embodiments. The accessory pouch 200*e* includes a first strip of material 240*a* defining the first plurality of accessory holders 242*a*-242*c*. Each of the first plurality of accessory holders 242*a*-242*c* include a first end 248*a* defining an opening 244 and a second end that defines an opening. The openings 244 are defined to receive a working portion of a tool therethrough.

In some embodiments, the accessory pouch 200*e* includes a second strip of material 240*b* defining a second plurality of accessory holders 246*a*-246*c*. The second plurality of accessory holders 246*a*-246*c* can be positioned adjacent to and/or overlapping with the first plurality of accessory holders 242*a*-242*c*. In some embodiments, the second plurality of accessory holders 246*a*-246*c* have openings 244 extending beyond the strip of material 240*a* defining the first plurality of accessory holders 242*a*-242*c*. In some embodiments, the accessory pouch 200*e* can also include a pocket 209 for catching and/or retaining the tip of a tool supported in any of the openings 244.

Figure 15:
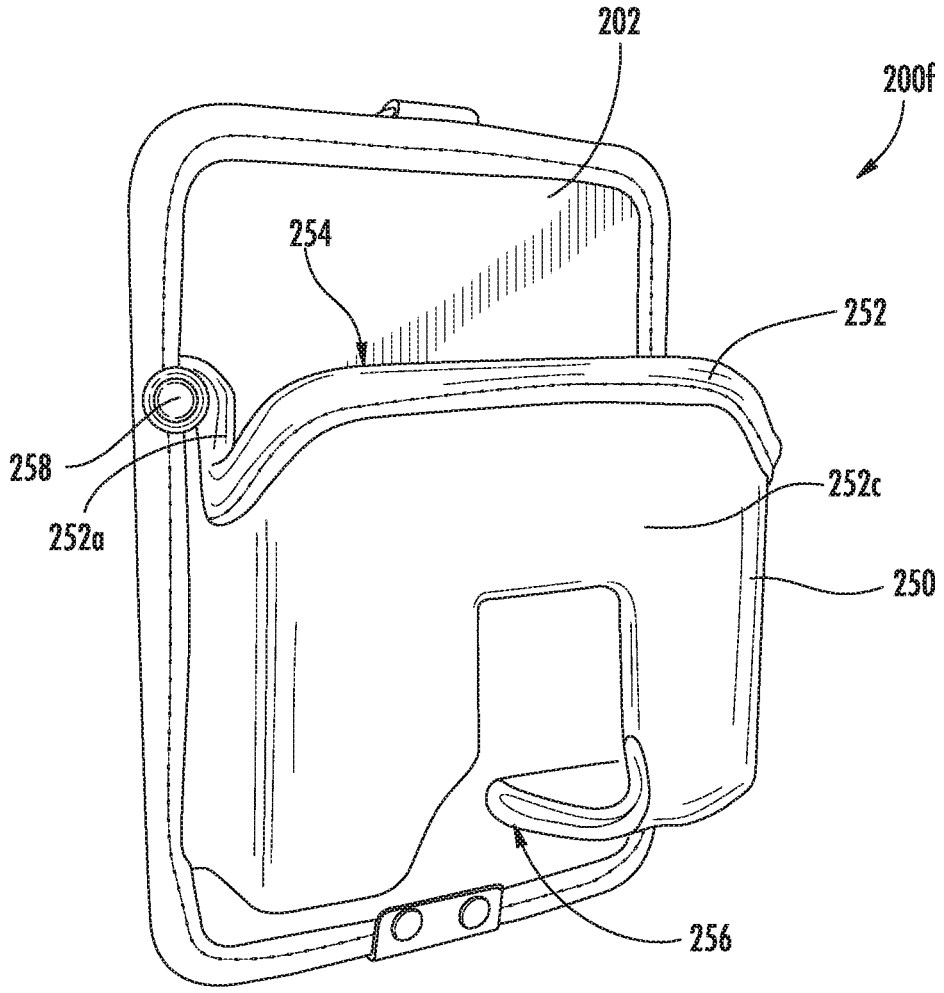
FIG. 15 is a front perspective view of an accessory pouch including a tape-dispensing pocket, in accordance with some embodiments.

FIG. 15 is a front, perspective view of an accessory pouch 200*f* including a tape-dispensing pocket 250, in accordance with some embodiments. The tape dispensing pocket 250 is defined by a surface 252 extending from the back wall 202. The surface 252 includes first and second perpendicular sections 252*a* extending from and coupled to the back wall 202 at a first end and a parallel section 252*c* extending from a first end of a first perpendicular section 252*a* to a second end of the second perpendicular section. The parallel section 252*c* defines a tape-dispensing opening 256. The tape-dispensing opening 256 is sized and configured to allow a user to access a free end of one or more tape rolls inserted into the tape-dispensing pocket 250 through an opening 254. In some embodiments, a retention device (not shown) can be coupled to a tape roll and the tap dispensing pocket 250 to maintain the tape roll in a fixed lateral position with respect to the tape dispensing pocket 250.

Figure 17:
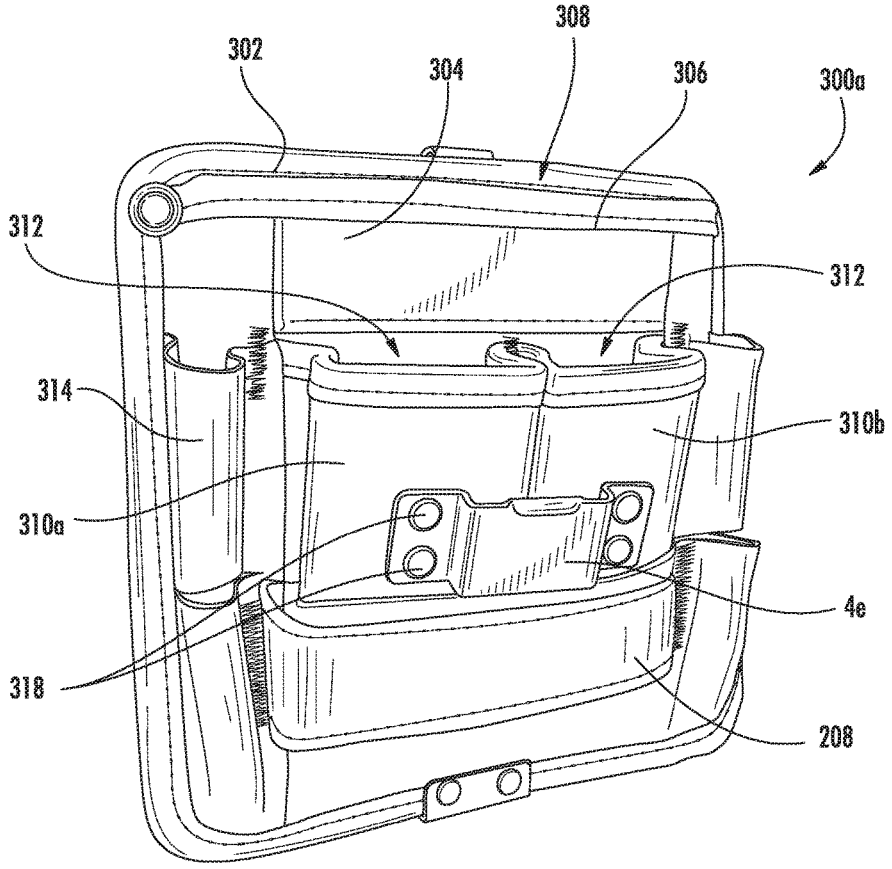
FIG. 17 is a front perspective view of an accessory pouch including a first accessory pocket, a plurality of second accessory pockets and a multifunction support bar, in accordance with some embodiments.

FIG. 17 is a front, perspective view of an accessory pouch 300*a* including a plurality of accessory pouches 310*a*, 310*b* and a hanging bar 4*e*, in accordance with some embodiments. The accessory pouch 300*a* is similar to the accessory pouches 200*a*-200*f* discussed above, and similar description is not repeated herein. The accessory pouch 300*a* includes a first pocket 304 coupled to the backing 302 of the accessory pouch 300*a*. The first pocket 304 is defined by a material strip 306 coupled to the backing 302 at a first end and a second end. The material strip 306 extends from the backing 302 and defines an opening 308 there between. The opening 308 is sized and configured to allow a user to access one or more accessories stored therein, such as one or more fasteners. The material strip 306 can be a rigid and/or flexible strip.

In some embodiments, a plurality of second pockets 310*a*, 310*b* are coupled to an outer surface of the first pocket 304. Each of the second pockets 310*a*, 310*b* are defined by a material strip 306 extending from the outer surface of the first pocket at a first end and a second end. The second pockets 310*a*, 310*b* each define an opening 312 at an upper edge. In some embodiments, the second pockets 310*a*, 310*b* are smaller than the first pocket 304. For example, in the illustrated embodiment, each of the second pockets 310*a*, 310*b* are about one-half the width of the first pocket 304, although it will be appreciated that the second pockets 310*a*, 310*b* can have any suitable width less than or equal to the width of the first pocket 304.

In some embodiments, one or more cylindrical pockets 314 can be coupled to the first pocket 304. The one or more cylindrical pockets 314 are sized and configured to receive one or more accessories therethrough, such as, for example, a marking device (such as a pencil). The one or more cylindrical pockets 314 are coupled to an outer surface of the first pocket 304 and can be positioned adjacent to the first and second ends of the material strip 306.

In some embodiments, a multifunction support bar 4*e* is coupled to an outer surface of one or more of the second pockets 310*a*, 310*b* and/or the first pocket 304. The support bar 4*e* is similar to the support bars 4*a*-4*d* discussed above, and similar description is not repeated herein. In some embodiments, the support bar 4*e* is coupled to the second pockets 310*a*, 310*b* by one or more rivets 318, although it will be appreciated that any suitable connection mechanism can be used to couple the support bar 4*e* the outer surface of the second pockets 310*a*, 310*b*.

Figure 18:
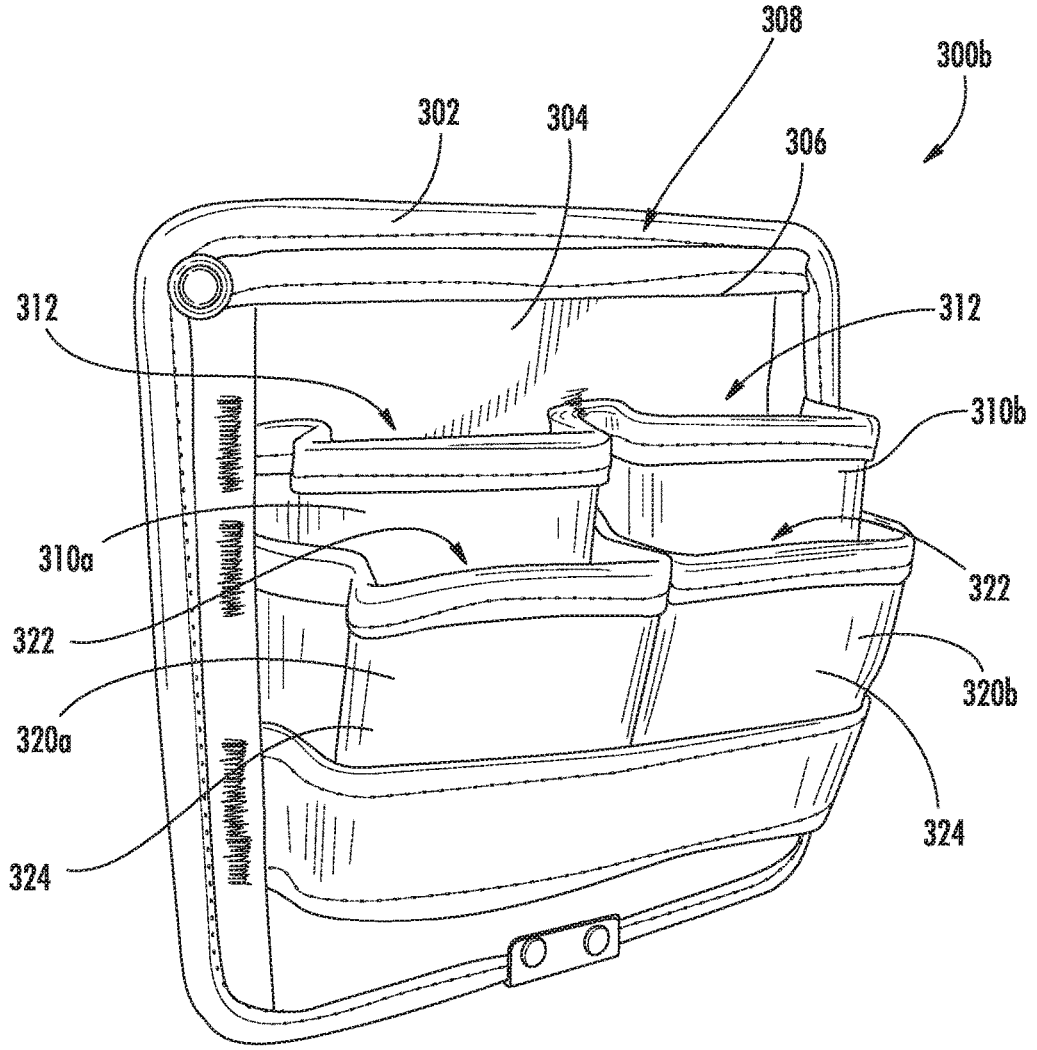
FIG. 18 is a front perspective view of an accessory pouch including a first accessory pocket, a plurality of second accessory pockets and a plurality of third accessory pockets, in accordance with some embodiments.

FIG. 18 is a front, perspective view of an accessory pouch 300*b* including a first accessory pockets 304, a plurality of second accessory pockets 310*a*, 310*b* and a plurality of third accessory pockets 320*a*, 320*b*, in accordance with some embodiments. The accessory pouch 300*b* is similar to the accessory pouch 300*a* discussed above, and similar description is not repeated herein. The accessory pouch 300*b* includes a plurality of third accessory pockets 320*a*, 320*b* coupled to an outer surface of the first pockets 304 and at least partially overlapping at least one of the second plurality of pockets 310*a*, 310*b*. Each of the third accessory pockets 320*a*, 320*b* includes an opening 322 positioned below an opening of a respective second accessory pocket 310*a*, 310*b*, although it will be appreciated that the opening 322 of the third accessory pocket 320*a*, 320*b* can be positioned below, level with, and/or above the opening 312 of the second accessory pockets 310*a*, 310*b*.

Figure 19:
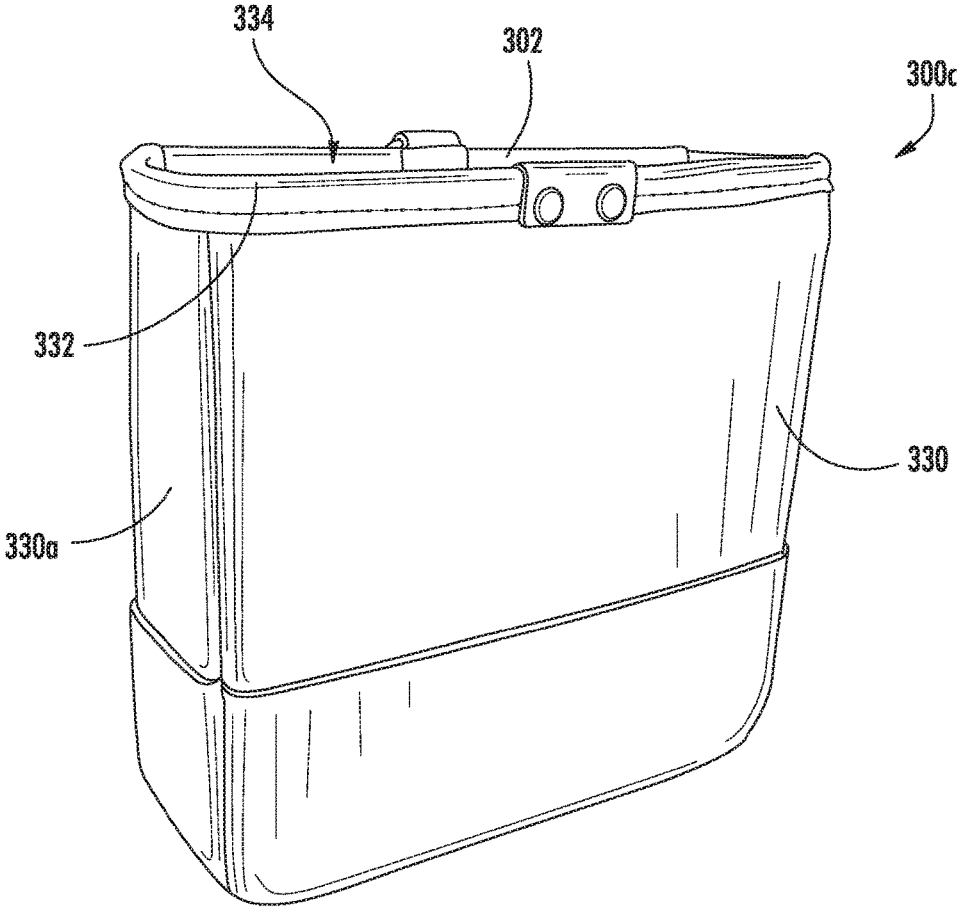
FIG. 19 is a front perspective view of an accessory pouch having an opaque accessory container, in accordance with some embodiments.

FIG. 19 is a front, perspective view of an accessory pouch 300*c* having an opaque accessory container 330, in accordance with some embodiments. The opaque accessory container 330 includes a first side wall 330*a* extending from a first side of the backing 302 and a second side wall extending from a second side of the backing 302. A longitudinal wall 332 extends from the first side wall 330*a* to the second side wall to define an inner volume 334. Although an opaque accessory container 330 is illustrated, it will be appreciated that at least a portion of the accessory container 330 can be formed from a transparent and/or semitransparent material, as discussed above with respect to FIG. 12.

Figure 20:
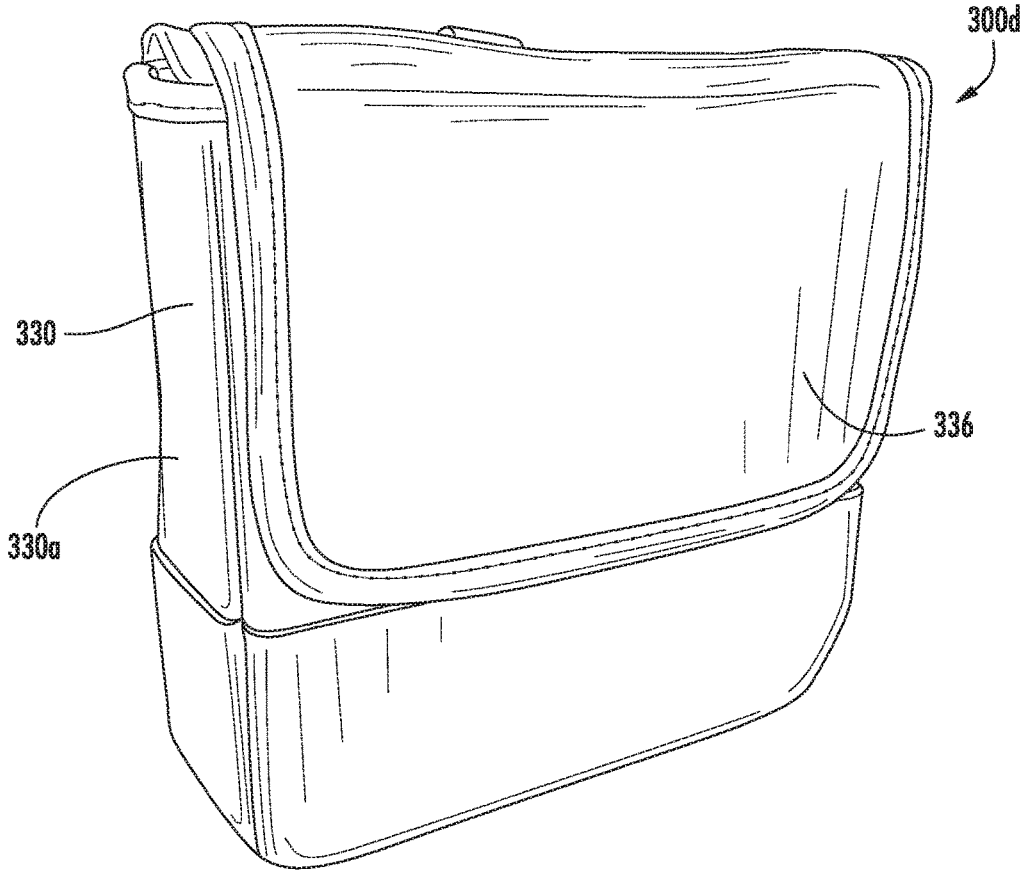
FIG. 20 is a front perspective view of an accessory pouch having an opaque accessory container and a flap, in accordance with some embodiments.

FIG. 20 is a front, perspective view of an accessory pouch 300*d* having an opaque accessory container 330 and a flap 336, in accordance with some embodiments. The accessory pouch 300*d* is similar to the accessory pouch 300*c*, and similar description is not repeated herein. The accessory pouch 300*d* includes a flexible flap 336 configured to cover an opening 334 of the opaque accessory container 330. The flexible flap 336 can be configured to completely and/or partially cover the opening of the opaque accessory container 330. The foregoing is provided for purposes of illustrating, explaining, and describing embodiments of this invention. Modifications and adaptations to these embodiments will be apparent to those skilled in the art and may be made without departing from the scope or spirit of this invention.

Although examples are illustrated and described herein, embodiments are nevertheless not limited to the details shown, since various modifications and structural changes may be made therein by those of ordinary skill within the scope and range of equivalents of the claims.

What is claimed is:

1. A multifunction tool support system, comprising:

a tool carrier, comprising a base with a wall extending from the base to define an open topped storage volume, wherein the wall comprises a front wall, a back wall, a first side wall, and a second side wall, wherein inner faces of the front wall and back wall face each other, and inner faces of the first side wall and second side wall face each other, wherein the tool carrier further comprises a handle coupled at opposite ends to the wall, wherein the handle is adapted for carrying the tool carrier, and a multifunction support bar coupled to a surface of the wall, the multifunction support bar comprising:

a longitudinal support section extending along a first longitudinal axis;

a first mounting section extending substantially along a second longitudinal axis and coupled to a first end of the longitudinal support section;

a second mounting section extending substantially along the second longitudinal axis and coupled to a second end of the longitudinal support section;

wherein the second longitudinal axis is parallel to and spaced apart from the first longitudinal axis; and wherein the first and second mounting sections are coupled to a surface such that the longitudinal support section and the surface define an elongated channel; and an accessory pouch configured to be coupled to the longitudinal support section, the accessory pouch comprising at least one coupling element sized and configured for insertion through the elongated channel;

wherein the elongated channel is adapted to receive at least two accessory pouches.

2. The multifunction tool support system of claim 1, wherein the longitudinal support section is coupled to each of the first and second mounting sections by respective first and second offset sections;

wherein the first offset section extends from the first end of the longitudinal support section at a predetermined angle; and wherein the second offset section extends from the second end of the longitudinal section at the predetermined angle.

3. The multifunction tool support system of claim 2, wherein the longitudinal support section is disposed substantially in a first plane having a predetermined planar offset from a second plane defined by the first and second mounting sections; and wherein the predetermined planar offset is determined by a length of the first and second offset sections and the predetermined angle.

4. The multifunction tool support system of claim 1, wherein the at least one coupling element comprises a clip coupled to a first surface of the accessory pouch.

5. The multifunction tool support system of claim 4, wherein the clip is rotatably coupled to the first surface of the accessory pouch.

6. The multifunction tool support system of claim 1, wherein the accessory pouch comprises at least one accessory pocket sized and configured to receive one or more accessories therein.

7. The multifunction tool support system of claim 1, wherein the accessory pouch comprises a multifunction support bar comprising:

a longitudinal support section extending on a first longitudinal axis;

a first mounting section extending substantially on a second longitudinal axis and coupled to a first end of the longitudinal support section; and a second mounting section extending substantially on the second longitudinal axis and coupled to a second end of the longitudinal support section;

wherein the second longitudinal axis is parallel to and spaced apart from the first longitudinal axis; and wherein the first and second mounting sections are coupled to a surface of the accessory pouch such that the longitudinal support section and the surface define a channel there between.

8. The multifunction tool support system of claim 1, wherein the surface comprises a surface of a tool carrier.

9. The multifunction tool support system of claim 1, wherein the surface comprises a surface of a working structure.

10. The multifunction tool support system of claim 1, comprising a third mounting section extending substantially along the second longitudinal axis and coupled to the longitudinal support section, wherein the third mounting section is positioned between the first mounting section and the second mounting section.

11. A tool holding system, comprising:

a tool carrier, comprising a base with a wall extending from the base to define an open topped storage volume, wherein the wall comprises a front wall, a back wall, a first side wall, and a second side wail, wherein inner faces of the front wall and back wall face each other, and inner faces of the first side wall and second side wall face each other, wherein the tool carrier further comprises a handle coupled at opposite ends to the wall, wherein the handle is adapted for carrying the tool carrier, and a multifunction support bar coupled to the a surface of the wall, the multifunction support bar comprising:

a longitudinal support section extending along a first longitudinal axis;

a first mounting section extending substantially along a second longitudinal axis and coupled to a first end of the longitudinal support section; and a second mounting section extending substantially along the second longitudinal axis and coupled to a second end of the longitudinal support section;

wherein the second longitudinal axis is parallel to and spaced apart from the first longitudinal axis;

wherein the first and second mounting sections are coupled to the surface of the tool carrier such that the longitudinal support section and the surface define an elongated channel; and an accessory pouch comprising at least one accessory holder sited and configured to receive an accessory therein;

wherein at least one coupling element sized and configured to be received in the elongated channel is coupled to the accessory pouch;

wherein the elongated channel is adapted to receive at least two accessory pouches; and wherein the accessory pouch is maintained on the multifunction support bar by the at least one coupling element.

12. The tool holding system of claim 11, wherein the longitudinal support section is coupled to each of the first and second mounting sections by respective first and second offset sections, wherein the first offset section extends from the first end of the longitudinal support section at a predetermined angle; and wherein the second offset section extends from the second end of the longitudinal section at the predetermined angle.

13. The tool holding system of claim 12, wherein the longitudinal support section is disposed substantially in a first plane having a predetermined planar offset from a second plane defined by the first and second mounting sections; and wherein the predetermined planar offset is determined by a :length of the first and second offset sections and the predetermined angle.

14. The tool holding system of claim 11, wherein the at least one coupling element comprises a clip coupled to a first surface of the accessory pouch.

15. The tool holding system of claim 14, wherein the clip is rotatably coupled to the first surface of the accessory pouch.

16. The tool holding system of claim 15, wherein the clip comprises:

a backing fixedly coupled to the accessory pouch by at least one fastener; a spacer fixedly coupled to the backing; and a retention portion rotatably coupled to the spacer;

wherein the retention portion is configured to rotate with respect to the backing and the spacer.

17. The tool holding system of claim 11, wherein the accessory holder comprises at least one pocket sized and configured to receive one or more accessories therein.

18. The tool holding system of claim 11, wherein the accessory pouch comprises a multifunction support bar comprising:

a longitudinal support section extending along a first longitudinal axis; a first mounting section extending substantially along a second longitudinal axis and coupled to a first end of the longitudinal support section; and a second mounting section extending substantially along the second longitudinal axis and coupled to a second end of the longitudinal support section;

wherein the second longitudinal axis is parallel to and spaced apart from the first longitudinal axis;

wherein the first and second mounting sections are coupled to a surface of the accessory pouch such that the longitudinal support section and the surface define a channel there between.

19. The tool holding system of claim 11, wherein the handle extends above the wall.

20. A tool holding system, comprising:

a tool carrier, comprising a base with a wall extending from the base to define an open topped storage volume, wherein the wall comprises a front wall, a back wall, a first side wall, and a second side wall, wherein inner faces of the front wail and back wall face each other, and inner faces of the first side wall and second side wall face each other, wherein the tool carrier further comprises a handle coupled at opposite ends to the wall, wherein the handle is adapted for carrying the tool carrier, and a multifunction support bar coupled to the a surface of the wall, the multifunction support bar comprising:

a longitudinal support section extending along a first longitudinal axis;

a first mounting section extending substantially along a second longitudinal axis and coupled to a first end of the longitudinal support section; and a second mounting section extending substantially along the second longitudinal axis and coupled to a second end of the longitudinal support section;

wherein the second longitudinal axis is parallel to and spaced apart from the first longitudinal axis;

wherein the first and second mounting sections are coupled to the surface of the tool carrier such that the longitudinal support section and the surface define an elongated channel; and wherein the elongated channel is adapted to receive at least two accessory pouches comprising at least one coupling element sized and configured to be received in the elongated channel.

* * * * *